US009328592B2

(12) United States Patent
Kerr et al.

(10) Patent No.: US 9,328,592 B2
(45) Date of Patent: May 3, 2016

(54) STEAM ANTI-CONING/CRESTING TECHNOLOGY ( SACT) REMEDIATION PROCESS

(71) Applicant: Nexen Energy ULC, Calgary, Alberta (CA)

(72) Inventors: Richard Kelso Kerr, Calgary (CA); Peter Yang, Calgary (CA)

(73) Assignee: NEXEN ENERGY ULC, Calgary, Alberta (CA)

( * ) Notice: Subject to any disclaimer, the term of this patent is extended or adjusted under 35 U.S.C. 154(b) by 187 days.

(21) Appl. No.: 13/889,775

(22) Filed: May 8, 2013

(65) Prior Publication Data

US 2013/0284461 A1 Oct. 31, 2013

Related U.S. Application Data

(63) Continuation-in-part of application No. 13/543,012, filed on Jul. 6, 2012, which is a continuation-in-part of application No. 13/628,164, filed on Sep. 27, 2012.

(60) Provisional application No. 61/644,100, filed on May 8, 2012, provisional application No. 61/507,196, filed on Jul. 13, 2011, provisional application No. 61/549,770, filed on Oct. 21, 2011.

(51) Int. Cl.
*E21B 43/24* (2006.01)
*E21B 43/32* (2006.01)

(52) U.S. Cl.
CPC ..... *E21B 43/24* (2013.01); *E21B 43/32* (2013.01); *E21B 43/2408* (2013.01)

(58) Field of Classification Search
CPC ..... E21B 43/16; E21B 43/24; E21B 43/243; E21B 43/2408; E21B 43/30
See application file for complete search history.

(56) References Cited

U.S. PATENT DOCUMENTS 3,976,137 A 8/1976 Bousaid
4,217,956 A 8/1980 Goss et al.
(Continued)

FOREIGN PATENT DOCUMENTS

WO WO 2006-074555 A1 7/2006
WO WO 2008-060311 A2 5/2008
WO WO 2010-092338 A2 8/2010
WO WO 2010-101647 A2 9/2010
WO WO 2013-006950 A2 1/2013

OTHER PUBLICATIONS

Adams et al., "Controls on the Variability of Fluid Properties of Heavy Oils and Bitumen in Foreland Basin: A Case History From the Albertan Oil Sands", Search & Discovery Article #40275, Mar. 10, 2008.

Aherne et al., "Fluid Movement in the SAGD Process: A Review of the Dover Project", Journal of Canadian Petroleum Technology, Jan. 2008.

(Continued)

*Primary Examiner* — Zakiya W Bates
(74) *Attorney, Agent, or Firm* — Norton Rose Fulbright Canada LLP

(57) ABSTRACT

A cyclic remediation process to restore oil recovery from a primary oil production well that has watered off from bottom water encroachment (cone or crest) whereby: (a) the primary oil production well has a produced water cut in excess of 95% (v/v); (b) the oil is heavy oil, with in-situ viscosity >1000 cp; wherein the process includes: (c) injecting a steam slug with a volume of 0.5 to 5.0 times the cumulative primary oil production, with steam volumes measured as water volumes; (d) shutting in the well for a soak period, after the steam injection is complete; and (e) producing the well until the water cut exceeds 95%.

14 Claims, 18 Drawing Sheets

SAGD PARTIAL CONING/CRESTING

(56) References Cited

U.S. PATENT DOCUMENTS

| | | | | |
|---|---|---|---|---|
| 4,265,310 | A | 5/1981 | Britton et al. | |
| 4,573,530 | A | 3/1986 | Audeh et al. | |
| 4,682,652 | A | 7/1987 | Huang et al. | |
| 4,860,827 | A | 8/1989 | Lee et al. | |
| 5,407,009 | A | 4/1995 | Butler et al. | |
| 5,456,315 | A | 10/1995 | Kisman et al. | |
| 5,626,193 | A | 5/1997 | Nzekwu et al. | |
| 6,015,015 | A | 1/2000 | Luft et al. | |
| 6,412,557 | B1 | 7/2002 | Ayasse et al. | |
| 7,581,587 | B2 | 9/2009 | Pfefferle | |
| 7,740,062 | B2 | 6/2010 | Lim et al. | |
| 7,780,152 | B2 | 8/2010 | Rao | |
| 7,900,701 | B2 | 3/2011 | Weiers et al. | |
| 2005/0045332 | A1 | 3/2005 | Howard et al. | |
| 2005/0211434 | A1 | 9/2005 | Gates et al. | |
| 2006/0207762 | A1 | 9/2006 | Ayasse | |
| 2006/0213658 | A1 | 9/2006 | Maguire | |
| 2006/0231252 | A1 | 10/2006 | Shaw et al. | |
| 2007/0187093 | A1 | 8/2007 | Pfefferle | |
| 2007/0187094 | A1 | 8/2007 | Pfefferle | |
| 2008/0190813 | A1* | 8/2008 | Dana et al. | 208/187 |
| 2008/0264635 | A1 | 10/2008 | Chhina et al. | |
| 2009/0188667 | A1 | 7/2009 | Lim et al. | |
| 2009/0236092 | A1 | 9/2009 | O'Brien | |
| 2009/0288827 | A1 | 11/2009 | Coskuner | |
| 2010/0065268 | A1 | 3/2010 | Gates et al. | |
| 2010/0096126 | A1 | 4/2010 | Sullivan et al. | |
| 2010/0212894 | A1 | 8/2010 | Latimer et al. | |
| 2010/0276148 | A1 | 11/2010 | Wylie et al. | |
| 2012/0247773 | A1* | 10/2012 | Schneider et al. | 166/302 |
| 2013/0098603 | A1 | 4/2013 | Kerr | |
| 2013/0175031 | A1 | 7/2013 | Kerr | |
| 2013/0248177 | A1 | 9/2013 | Kerr | |
| 2013/0284435 | A1 | 10/2013 | Kerr | |

OTHER PUBLICATIONS

Akram, "Reservoir Simulation Optimizes SAGD", American Oil & Gas Reporter (AOGR), Sep. 2010.

Alberta Chamber of Resources, "Oil Sands Technology Roadmap", Jan. 30, 2004, p. 27-32.

Alberta Energy, "Gas Over Bitumen Technical Solution—Technical Solution Roadmap", www.energy.alberta.ca, 2011.

Ashrafi et al., "Numerical Simulation Study of SAGD Experiment and Investigating Possibility of Solvent Co-Injection", Society of Petroleum Engineers, Jul. 19-21, 2011.

Asia Industrial Gases Association (AIGA), "Oxygen Pipeline Systems", 2005.

Balog et al., "The Wet Air Oxidation Boiler for Enhanced Oil Recovery", Journal of Canadian Petroleum, Sep.-Oct. 1982, p. 73-79.

Belgrave et al., "SAGD Optimization With Air Injection", Society of Petroleum Engineers, SPE 106901, Apr. 15-18, 2007.

Bennion et al., "The Use of Carbon Dioxide as Enhanced Recovery Agent for Increasing Heavy Oil", Joint Canada/Romania Heavy Oil Symposium, Mar. 3-7, 1993, p. 1-37.

Berkowitz, "Fossil Hydrocarbons", Academic Press, 1997.

Braswell, "New Heavy Oil Solvent Extraction Pilot to Test Experimental Process", Journal of Petroleum Technology Online, Jan. 9, 2012.

Brennan, "Screw Pumps Provide High Efficiency in Transport of Orinoco Bitumen", Pipeline & Gas Journal, vol. 222, Issue 3, Mar. 1995, p. 36-39.

Brigham et al., "In Situ Combustion", Chptr. 16, Reservoir Engineering, May 16, 2005.

Business Wire, "ELAN Energy Announces Nine Months Results", Nov. 1996.

Business Wire, "ELAN Energy Announces Six Months Results", Aug. 1996.

Butler, "Thermal Recovery of Oil and Bitumen", Prentice Hall, 1991, p. 4-15.

Canadian Association of Petroleum Producers (CAPP), "The Facts on Oil Sands", 2010.

Carcoana, "Enhanced Oil Recovery in Rumania", Society of Petroleum Engineers, SPE/DOE 10699, Apr. 4-7, 1982.

Chen et al., "Effects of Reservoir Heterogeneities on Steam-Assisted Gravity-Drainage Process", Society of Petroleum Engineers, V.11, No. 5, Oct. 2008.

Chen, "Assessing and Improving SAGD: Reservoir Homogeneities, Hydraulic Fractures and Mobility Control Foams" Stanford PhD Thesis, May 2009.

Chu, "A Study of Fireflood Field Projects", Journal of Petroleum Technology, Feb. 1977, p. 111-120.

Craig et al., "A Multipilot Evaluation of the COFCAW Process", Journal of Petroleum Technology, Jun. 1974, p. 659-666.

Dang et al., "Investigation of SAGD in Complex Reservoirs", SPE 133849-MS, Society of Petroleum Engineers, 2010.

Das, "Well Bore Hydraulics in a SAGD Well Pair", Society of Petroleum Engineers, 97922-MS, Nov. 1-3, 2005.

Dietz et al., "Wet and Partially Quenched Combustion", Journal of Petroleum Technology, Apr. 1968, p. 411-415.

Donaldson, et al., "Enhanced Oil Recovery II, Process and Operations", Chapter 11, Elsevier, 1989.

Dusseault, "Comparing Venesuelan and Canadian Heavy Oil and Tar Sands", Canadian Inst. Mining (CIM), Jun. 12-14, 2011.

Edmunds et al., "Economic Optimum Operating Pressure for SAGD Projects in Alberta", Journal of Canadian Petroleum Technology, V. 40, Dec. 2001, p. 13-17.

Elliot et al., "Computer Simulation of Single-Well Steam Assisted Gravity Drainage", U.S. Dept. of Energy Contract No. DE-FG22-96BC14994, Jul. 1999.

Ei-Sayed et al., "Horizontal Well Length: Drill Short or Long Wells?", Society of Petroleum Engineers, Nov. 18-20, 1996, p. 423-431.

Escobar, et al., "Optimization Methodology for Cyclic Steam Injection With Horizontal Wells", Society of Petroleum Engineers, Nov. 6-8, 2000.

Fadillah, "12 Oil Companies to Use EOR Methods to Boost Production", The Jakarta Post, Jun. 4, 2013.

Falk et al, "A Review of Insulated Concentric Coiled Tubing for Single Well, Steam Assisted Gravity Drainage (SWSAGD)", Society of Petroleum Engineers, Feb. 26-28, 1996.

Farouq Ali et al., "The Promise and Problems of Enhanced Oil Recovery Methods", Journal of Canadian Petroleum Technology, V. 35, No. 7, Sep. 1996, p. 57-63.

Fatemi et al., "Injection Well-Producer Well Combinations for Toe-to-Heel Steam Flooding (THSF)", Society of Petroleum Engineers, 140703-MS, May 23-26, 2011.

Fatemi et al., "Preliminary considerations on the application of toe-to-heel steam flooding (THSF): Injection well-producer well configurations", Chem. Eng. Res. & Design, V. 8, No. 11, 2011, p. 2365-2379.

Finan et al., "Nuclear Technology & Canadian Oil Sands: Integration of Nuclear Power with In-Situ Oil Extraction", MIT Thesis, Jun. 2007.

Frauenfeld et al., "Effect of an Initial Gas Content on Thermal EOR as Applied to Oil Sands", Journal of Petroleum Technology, Mar. 1988.

Gates et al., "In-Situ Combustion in the Tulare Formation, South Belridge Field, Kern County, California", Journal of Petroleum Technology, May 1978, p. 798-806.

Godin, "Clean Bitumen Technology Action Plan—From Strategy to Action", PTSC Water forum, May 16, 2011.

Greaves et al., "In Situ Combustion (ISC) Process Using Horizontal Wells", Journal of Canadian Petroleum Technology, vol. 35, No. 4, Apr. 1996, p. 49-55.

Greaves et al., "THAI—New Air Injection Technology", Society of Petroleum Engineers, Report 99-15, Jun. 14-18, 1995.

Green Car Congress, "Chevron Leveraging Information Technology to Optimize Thermal Production of Heavy Oil with Increased Recovery and Reduced Costs", Jun. 23, 2011.

Gutierrez et al., "The Challenge of Predicting Field Performance of Air Injection Projects Based on Laboratory and Numerical Modelling", Journal of Canadian Petroleum Technology, vol. 48, No. 4, Apr. 2009, p. 23-34.

(56) References Cited

OTHER PUBLICATIONS

Haggett et al., "Update 3-Long Lake Oil Sands Output May Lag Targets", Reuters, Feb. 10, 2011.
Halliburton, "Zonal Isolation for Steam Injection Applications", www.halliburton.com, 2010.
Hanzlik et al., "Forty Years of Steam Injection in California—The Evolution of Heat Management", Society of Petroleum Engineers, SPE 84848, Oct. 20-21, 2003.
Healing, "Petrobank Technology Earns Zero Grade", Calgary Herald, Mar. 10, 2012.
Heidrick et al., "Oil Sands Research and Development", Alberta Energy Research Inst., Mar. 2006.
Herbeck et al., "Fundamentals of Tertiary Oil Recovery", Energy Publications, 1977.
Herrera et al., "Wellbore Heat Losses in Deep Steam Injection Wells," The Society of Petroleum Engineers Regional Mtg., Apr. 12, 1978.
Hong et al., "Effects of Noncondensable Gas Injection on Oil Recovery by Steamflooding", Journal of Petroleum Technology, Dec. 1984.
Huygen et al., "Wellbore Heat Losses and Leasing Temperatures During Steam Injection", Apr. 1966, p. 25-32.
Improved Recovery Week, "Thermal System Ups Heavy Oil Flow; Lighter Crudes Eligible?", Dec. 4, 1995.
Integra Engineering Ltd., "Pushwater Systems Extend Heavy Oil Collection", 2011.
Ipek et al, "Numerical Study of Shale Issues in SAGD", Canadian Int'l Pet. Conf., Calgary, Jun. 17, 2008.
Jacos, "Jacos Hangingstone Expansion Project", www.jacos.com, Apr. 2010.
Jaremko, "Pressure Communication", Oilweek, Feb. 2006.
Javad et al., "Feasibility of In-Situ Combustion in the SAGD Chamber", Journal of Canadian Petroleum Technology, Jan. 27, 2011, p. 31-44.
Johnson et al., "Production Optimization at Connacher's Pod One (Great Divide) Oil Sands Project", Society of Petroleum Engineers, SPE Report No. 145091-MS, Jul. 19-21, 2011.
Jorshari, "Technology Summary", Journal of Canadian Petroleum Technology, 2011.
Kerr et al., "Sulphr Plant Waste Gasses: Incineration Kinetics and Fuel Consumption", Western Research & Development Ltd., Jul. 1975.
Kisman et al., "Development and Economic Application of Anti-Water Coning Methods to Alleviate a Widespread Problem", 5th Unitar Int'l Conf. on Heavy Crude and Tar Sands, 1991, p. 279-287.
Kristoff et al., Winter Horizontal Well EOR Project, Phase III, Wascana Energy Inc., SRC Pub. No. P-110-436-C-99, Nov. 1999.
Kumar et al., "Cyclic Steaming in Heavy Oil Diatomite", Society of Petroleum Engineers, Mar. 8-10, 1995, p. 109-122.
Lai et al, "Factors Affecting the Application of Anti-Water Coning Technology (AWACT) at the South Jenner Oil Field, Southeast Alberta", Journal of Canadian Petroleum Technology, vol. 38, No. 3, Mar. 1999, p. 25-37.
Lake et al., "A Niche for Enhanced Oil Recovery in the 1990s", Oilfield Rev., Jan. 1992.
Lange, "Handbook of Chemistry", McGraw Hill, 1973.
Leung, "Numerical Evaluation of the Effect of Simultaneous Steam and Carbon Dioxide Injection on the Recovery of Heavy Oil", Society of Petroleum Engineers, Sep. 1983, p. 1591-1599.
Li et al, "Gas-Over-Bitumen Geometry and its SAGD Performance Analysis with Coupled Reservoir Gas Mechanical Simulation", Journal of Canadian Petroleum Technology, Jan. 2007, p. 42-49.
Li et al., "Numerical Investigation of Potential Injection Strategies to Reduce Shale Barrier Impacts on SAGD Process", Journal of Canadian Petroleum Technology, Mar. 2011, p. 57-64.
Liebe et al., Winter Horizontal Well EOR Project, Phase IV, Wascana Energy Inc., SRC Pub. No. P-110-606-C-02, Dec. 2002.
Lowey, "Bitumen Strategy Needs Better Grounding: EUB Study Offers Bad News for Athabasca Gas Producers", Business Edge, V. 4, No. 2, Jan. 15, 2004.
Luft, et al., "Thermal Performance of Insulated Concentric Coiled Tubing (ICCT) for Continuous Steam Injection in Heavy Oil Production.", Society of Petroleum Engineers, 37534-MS, Feb. 10-12, 1997.
Luhning et al., "The AOSTRA Anti Water Coning Technology (AWACT) Process—From Invention to Commercial Application", SPE Paper No. CIM/SPE 90-132, 1990, p. 132.1-132.8.
Luo et al., "Feasibility Study of CO2 Injection for Heavy Oil Reservoir After Cyclic Steam Simulation: Liaohe Oil Field Test", Society of Petroleum Engineers, Nov. 1-3, 2005.
Marufuzzanan, "Solubility and Diffusivity of Carbon Dioxide, Ethane, and Propane in Heavy Oil", University of Regina, M.A.Sc. Thesis, Nov. 2010.
McColl, "Nuclear Energy: Hedging Option for the Oil Sands", Nov. 2, 2006.
Moore et al., "In Situ Combustion Performance in Steam Flooded Heavy Oil Cores", Journal of Canadian Petroleum Technology, vol. 38, No. 13, 1999.
Moore et al., "Parametric Study of Steam Assisted In Situ Combustion", Final Report, vols. 1-2, 1994, p. 1-336.
Nasr, et al., "Thermal Techniques for the Recovery of Heavy Oil Bitumen", Society of Petroleum Engineers, Dec. 5-6, 2005.
New Technology Magazine, "EnCana Plans First Commercial Use of Solvent in New Oilsands Project", Nov. 2009, p. 10.
New Technology Magazine, "Excelsior Files Patent for ISC Process", www.newtechmagazine.com, Sep. 25, 2009.
New Technology Magazine, "Excelsior Searching for Joint Venture Partner for Hangingstone CEGD Project", www.newtechmagazine.com, Nov. 20, 2009.
New York Times, Business Wire, "Ranger Oil in $408M Deal for Elan Energy", Sep. 3, 1997.
Nexen Inc., "Nexen Announces Second Quarter Results", Aug. 4, 2011.
N-solv Corporation, "Developing an In Situ Process for the Oilsands", 2012.
Oil & Gas Journal, "Self-Setting Thermal Packers Help Cyclic Steam", www.ogj.com Dec. 14, 1998.
Oil & Gas Journal, "Special Report: More US EOR Projects Start But EOR Production Continues Decline", Apr. 21, 2008.
Oilsands Quest, "Management Presentation", 2011.
Pacheco et al., "Wellbore Heat Losses and Pressure Drop in Steam Injection", The Journal of Petroleum Technology, Feb. 12, 1972, p. 139-144.
Parappilly et al., "SAGD With a Longer Wellbore", Journal of Canadian Petroleum Technology, V. 48, No. 6, Jun. 2009, p. 71-77.
Parrish et al., "Laboratory Study of a Combination of Forward Compustion and Waterflooding—The COFCAW Process", Journal of Petroleum Technology, Jun. 1969, p. 753-761.
Patton et al., "Carbon Dioxide Well Stimulation: Part 1—A Parametric Study", Journal of Petroleum Technology, Aug. 1982, p. 1798-1804.
Piers, "Coping With Water From Oil & Gas Wells", C-FER Technologies, Jun. 14, 2005.
Pooladi-Darvish et al., "SAGD Operations in the Presence of Underlying Gas Cap and Water Layer-Effect of Shale Layers", Journal of Canadian Petroleum Technology, V. 41, No. 6, Jun. 2002.
Prats et al., "In Situ Combustion Away From Thin, Horizontal Gas Channels", Society of Petroleum Engineers Journal, Mar. 1968, p. 18-32.
Ramey, "In Situ Combustion", Proc. 8th World Pet. Long., 1970, p. 253-262.
Roche, "Beyond Steam", New Technology Magazine, Sep. 2011.
Roche, "No Analogue", New Technology Magazine, Apr. 2009, p. 10.
Ross, "Going the Distance", New Technology Magazine, Dec. 2008, p. 34.
Ross, "Injecting Air Replaces Gas in Depleted Gas Over Bitumen Reservoir", New Technology Magazine, May 2009, p. 34-46.
Saltuklaroglu et al., "Mobil's SAGD Experience at Celtic, Saskatchewan", SPE, 99-25, 1999, p. 45-51.
Sarathi, "In-Situ Combustion Handbook—Principals and Practices", Report Prepared for U.S. Department of Energy, Jan. 1999.

(56) References Cited

OTHER PUBLICATIONS

Sarkar et al., "Comparison of Thermal EOR Processes Using Combinations of Vertical and Horizontal Wells", Society of Petroleum Engineers, SPE 25793 Feb. 8-10, 1993, p. 175-181.
Satter, "Heat Losses During Flow of Steam Down a Wellbore", The Journal of Petroleum Technology, Jul. 1965, p. 845-851.
Schindelar et al., Mideast Heavy Oil Pilot Delivers for Chevron, The Daily Oil, Oct. 21, 2010.
Schlumberger Ltd., www.slb.com, "Packer Systems", May 2012.
Shin et al., "Shale Barrier Effects on SAGD Performance", Society of Petroleum Engineers, SPE 125211-MS, Oct. 19-21, 2009.
Shore, "Making the Flare Safe", Journal of Loss Prevention in the Process Industries, V.9, No. 6, 1996, p. 363-381.
Singhal et al., "A Mechanistic Study of Single-Well Steam Assisted Gravity Drainage", SPE, 59333-MS, Apr. 3-5, 2000.
Stalder, "Cross-SAGD (XSAGD)—An Accelerated Bitumen Recovery Alternative", Society of Petroleum Engineers, V. 10, No. 1, Nov. 1-3, 2005.
Stevens et al., "A Versatile Model for Evaluating Thermal EOR Production Economics", Society of Petroleum Engineers, No. 1998. 113, 1998.
Stockwell et al., "Transoil Technology for Heavy Oil Transportation: Results of Field Trials at Wolf Lake", Society of Petroleum Engineers, 1988, p. 248-258.
Stone et al., "Flares", Chptr. 7, www.gasflare.org, Dec. 1995, p. 7.1-7.44.
Stone et al., "Flares", Chptr. 7, www.gasflare.org, Dec. 2012, p. 7.1-7.44.
Tan et al., "Application of a Thermal Simulator with Fully Coupled Discretized Wellbore Simulation to SAGD", Journal of Canadian Petroleum Technology, vol. 41, No. 1, 2002, p. 25-30.
Tavallali, "Assessment of SAGD Well Configuration Optimization in Lloydminster Heavy Oil Reserve", Society of Petroleum Engineers, SPE 153128, Mar. 20-22, 2012.
Thimm et al., "A Statistical Analysis of the Early Peace River Thermal Project Performance", Journal of Canadian Petroleum Technology, V. 32, No. 1, Jan. 1993.
Thomas, "Enhanced Oil Recovery—An Overview", Oil & Gas Science & Technology, V. 63, No. 1, p. 9-19, 2008.
Triangle Three Engineering, "Technical Audit Report—Gas Over Bitumen Technical Solutions", 2010.
Turta et al., "Preliminary Considerations on Application of Steamflooding in a Toe-to-Heel Configuration", 130444-PA, Journal of Canadian Petroleum Technology, V. 48, No. 11, Nov. 2009.
U.S. Department of Energy, "Enhanced Geothermal Systems—Wellfield Construction Workshop", San Francisco, Oct. 16, 2007.
U.S. Environmental Protection Agency, "Industrial Flares", www.epa.gov/ttn/chief/ap42/ch13/final/c13s05.pdf, Jun. 2012.
Vanderklippe, "Long Lake Project Hits Sticky Patch", The Globe and Mail, Feb. 10, 2011.
Walley, Middle East Enhanced Oil Recovery, www.arabianoilandgas.com, May 5, 2011.
Wikipedia, "Orimulsion", 2013.
Willhite et al., "Wellbore Refluxing in Steam Injection Wells", Journal of Petroleum Technology, Mar. 1987 ,, p. 353-362.
www.lloydministerheavyoil.com, "Completions and Workovers", 2012.
Xinhua's China Economic Information Service, "China's First Orimulsion Pipeline Comes on Steam", Nov. 7, 2006.
Yang et al., "Combustion Kinetics of Athabasca Bitumen From ID Combustion Tube Experiments", Int'l Assoc. for Mathematical Geology, Sep. 2009, p. 193-211.
Yang et al., "Design and Optimization of Hybrid Ex Situ / In Situ Steam Generation Recovery Processes for Heavy Oil and Bitumen", Canadian Heavy Oil Association, SPE 117643, Oct. 20-23, 2008.
Yang et al., "Design of Hybrid Steam—In Situ Combustion Bitumen Recovery Process", 2009, p. 213-223.
Yang et al., "The Design of Hybrid Steam-In Situ Combustion Bitumen Recovery Processes", Proceedings of the Canadian Int'l Petroleum Conference/SPE Gas Technology Symp. Joint Conference, Paper 2008-114, Jun. 17-19, 2008.
Zawierucha et al., Material Compatibility and Systems Considerations in Thermal EOR Environments Containing High-Pressure Oxygen, Journal of Petroleum Technology, Nov. 1988, p. 1477-1483.
U.S. Appl. No. 14/582,819, filed Dec. 24, 2014, Kerr.
Restriction Requirement for U.S. Appl. No. 13/543,012, mailed Aug. 11, 2014, 6 pages.
Official Action for U.S. Appl. No. 13/543,012, mailed Oct. 3, 2014, 28 pages.
Official Action for U.S. Appl. No. 13/628,164, mailed Mar. 13, 2014, 7 pages.
Notice of Allowance for U.S. Appl. No. 13/628,164, mailed Sep. 26, 2014, 8 pages.
United States Patent and Trademark Office, Office Action dated Feb. 26, 2015, issued in U.S. Appl. No. 14/058,488.
United State Patent and Trademark Office, Office Action dated Mar. 6, 2015, issued in U.S. Appl. No. 14/078,983.
United States Patent and Trademark Office, Office Action dated Apr. 9, 2015, issued in 13/888,874.

* cited by examiner

CONES/CRESTS LEAN ZONES

SAGD BITUMEN LEAN ZONES (BOTTOM WATER)

THE DHOWS CONCEPT

REVERSE CONING CONTROL

AWACT EFFECTS ON RELATIVE PERMEABILITY

PRE AWACT VS POST AWACT OIL RECOVERY

INCREMENTAL OIL ($m^3$)/WELL

FREQUENCY DISTRIBUTION INCREMENTAL OIL FOLLOWING AWACT

INCREMENTAL AWACT RESERVES

AWACT ON HORIZONTAL WELLS

CHOICE OF AWACT GASES - AWACT LAB TESTS

CYCLIC $CO_2$ STIMULATION OF OIL WELLS

STEAM STRING FOR SACT

SEPARATE STEAM INJECTOR FOR SACT

SACT WELL FOR CRESTED HEAVY OIL WELLS
(STEAM ANTICONING/CRESTING TECHNOLOGY)

SAGD PARTIAL CONING/CRESTING

WHERE: (1) RESERVOIR T=10 DEGREES CELCIUS
(2) STEAM P=10mPa
(3) STEAM Q=70%

HEAT CONDUCTION AROUND A HOT WELL

SACT SIMULATION VERTICAL VS HORIZONTAL WELLS

HZ SACT (HEEL) - Steam is injected at the heel of the horizontal producer into the crest zone
HZ - Horizontal Well
HZ SACT (MID) - Steam is injected at the mid point of the horizontal producer into the crest zone

SACT SIMULATION II HORIZONTAL WELLS

SACT SCALED PHYSICAL MODEL STEAM INJECTED RATES

SACT SCALED PHYSICAL MODEL STEAM SLUG SIZES

SACT SCALED PHYSICAL MODEL WATER CUT OFF

SACT SCALED PHYSICAL MODEL HORIZONTAL WELL LENGTHS

STEAM ANTI-CONING/CRESTING TECHNOLOGY ( SACT) REMEDIATION PROCESS

BACKGROUND OF THE INVENTION

As illustrated in FIG. 1A, many oil reservoirs have an active bottom water zone 20 beneath a net-pay zone containing oil. If oil, particularly high viscosity in-situ oil, is pumped from a vertical well completed in the oil zone, water can cone up to the production well and inhibit production. In terms of production, coning will reduce oil cuts and increase water cuts until it is no longer economic to produce the well. In the industry, the well is said to have "watered off". The mobility ratio of the oil determines the rate and extent of water coning. Typically, when the oil is heavier, the worse the water-coning problem is. As illustrated in FIG. 2, the problem may also be exhibited in SAGD for bitumen recovery with bottom water reservoirs.

Attempts have been made to prevent coning/cresting when reservoir characteristics are known. However, these attempts have had limited impact. Examples of attempts include the following:

1) The production well is completed higher up in the net pay zone, so the water cone has to be elongated before the well waters off. This is a temporary fix at best, and extra production is often marginal.

2) As illustrated in FIG. 1B, a horizontal well is drilled so the pressure drop of pumping is spread over the length of the horizontal well. However, water will eventually encroach to the well and produce a water crest zone 10 of high water saturation. Similar to a vertical well, the well will water off.

3) Oil production rates are minimized to delay or prevent coning/cresting

4) As illustrated in FIG. 3, downhole oil/water separator 30 (DHOWS) with downhole water disposal is installed. (Piers, K. Coping with Water from Oil and Gas Wells, CFER, Jun. 14, 2005). The downhole device can be a cyclone. This device, however, requires a suitable disposal zone 40 for water, and it works best on light oils with a high density difference between water and oil. This is not practical for heavier oils.

5) As illustrated in FIG. 4, a reverse coning system 50 is installed (Piers, 2005). Water 60 and oil 70 are produced or pumped separately in this system to control coning. Again for heavier oils, the water pumping rate to control coning is very large and impractical.

There have also been attempts to limit the coning/cresting when reservoir characteristics are unknown or coning/cresting isn't large enough to justify prevention investments. Known remediation attempts have had limited impact. Examples of these attempts include the following:

(1) Blocking agents are used to inhibit water flow in the cone/crest zones. Blocking agents include gels, foams, paraffin wax, sulfur, and cement. Each of these have been tried with limited success (Piers (2005)), (El-Sayed, et al., Horizontal Well Length: Drill Short or Long Wells?, SPE 37084-MS, 1996).

(2) Another reactive process is to shut in the oil well that has coned/crested. Gravity will cause the cone/crest zone to re-saturate with oil. However, when the oil is heavier, the time for re-saturation can be very long and the benefits can be marginal.

(3) A slug of gas is injected into the cone/crest zone. In the early 1990's, a process called anti-water coning technology (AWACT) was developed and tested in medium/heavy oils (AOSTRA, AWACT presentation, March 1999). The AWACT process involves injecting natural gas (or methane) to displace water, followed by a soak period (Luhning et al, The AOSTRA anti-water coning technology process from invention to commercial application, CIM/SPE 90-132, 1990). Lab tests indicated that the preferred gas ($CO_2$ or $CH_4$) has some solubility in oil or water (FIG. 9). The following mechanisms were expected to be activated.

a. On the "huff" part of the cycle or when gas is injected, methane displaces mobile water and bypasses the oil in the cone zone.

b. On the "soak" cycle or when the well is shut-in, methane absorbs slowly into the oil to reduce viscosity, lower interfacial tension, and cause some swelling c. On the "puff" cycle or when the well is produced, gas forms ganglia/bubbles that get trapped to impede water flow. As illustrated in FIG. 5, this creates a change in relative permeability. Oil cuts are improved and oil production is increased.

However, benefits only last a few years, and the process can only be repeated 5 or 6 times. Table 1 below summarizes AWACT field tests for 7 reservoir types (AOSTRA (1999)). Oil gravity varied from 13 to 28 API, and in situ viscosity varied from 6 to 1200 cp. AOSTRA suggested the following screens for AWACT—1) sandstone reservoir; 2) oil-wet or neutral wettability; 3) in situ viscosity between 100 to 1000 cp; 4) under saturated oil; and 5) greater than 10 m net pay.

TABLE 1

AWACT Reservoir Characteristics

South Jenner AWACT Treatment Summary
(Based on 34 treatments evaluated)

| | Average Production | | | | AWACT | AWACT Net Production | | AWACT Gas Slug | |
|---|---|---|---|---|---|---|---|---|---|
| | Pre AWACT | | Post AWACT | | Duration | m3 oil/m3 water | | Size | Ratio |
| Well Grouping | MOPD | OC % | MOPD | OC % | Months | One Year | Duration | km3 | m3m3 |
| 1. All wells | 3.0 | 9.7 | 2.9 | 19.9 | 22 | 73/(7,900) | 315/(17,700) | 144 | 22.0 |
| 2. 30 wells with increased OC | 3.0 | 10.0 | 2.9 | 21.7 | 23 | 102/(8,800) | 365/(19,900) | 148 | 22.0 |
| 3. 15 wells with increased MOPD | 2.5 | 11.7 | 3.8 | 25.5 | 23 | 630/(11,100) | 1,350/(26,500) | 148 | 25.4 |
| 4. 19 wells with decreased MOPD | 3.4 | 7.9 | 2.2 | 15.2 | 21 | (370)/(5,400) | (510)/(10,700) | 151 | 20.1 |

TABLE 1-continued

AWACT Reservoir Characteristics

| | | | | | | | | | | |
|---|---|---|---|---|---|---|---|---|---|---|
| 5. | 14 wells with increased MOPD & OC | 2.6 | 12.0 | 4.1 | 27.5 | 23 | 650/(11,700) | 1400/(27,900) | 154 | 33.0 |
| 6. | 10 water wetting treated wells | 2.9 | 9.4 | 3.3 | 19.0 | 28 | 215/(8,700) | 600/(24,800) | 119 | 21.4 |
| 7. | 23 non-chemically treated wells | 3.0 | 9.6 | 2.8 | 20.6 | 19 | 0/(7,800) | 165/(15,000) | 167 | 27.4 |

( ) numbers in brackets are negative

* ratio is $m^3$ gas per $m^3$ of cumulative oil production prior to treatment

Reservoir Characteristics of Other AWACT Treated Pools

| Field | Formation | Net Pay m | Permeability md | Porosity frac. | Water Saturation % | Oil Gravity ° API | Oil Viscosity cp | Pressure kPa | Rsl * m3/m3 |
|---|---|---|---|---|---|---|---|---|---|
| Bellshill Lake | Basal Quartz/Ellerslie | 12-13 | 900 | 0.23 | 0.29 | 28 | 9.2 | 5900 | 20 |
| Provost | Dina | 8.5 | 1000 | 0.22 | 0.35 | 28 | 6.5 | n/a | 30 |
| Chin Coulee | Taber | 7.6 | 500-1000 | 0.20 | 0.30 | 24 | 140 | 8274 | n/a |
| Suffield | Upper Mannville | 16 | 1000 | 0.27 | 0.25 | 13-14 | 500 | 8760 | 20 |
| Provost | McLaren | 15 | 1000-5000 | 0.31 | 0.30 | 13 | 1200 | n/a | 14 |
| Jenner | Upper Mannville | 12-16 | 1000-2000 | 0.26 | 0.27 | 15-17 | 66 | 8010 | 33 |
| Grassy Lake | Upper Mannville | 16-17 | 1000-2000 | 0.27 | 0.23 | 17-19 | 76 | 9600 | 11 |

* Initial Reservoir GOR

As illustrated in FIGS. 6 and 7, AWACT was not always a success (Lai et al., Factors affecting the application of AWACT at the South Jenner oil field, Southeast Alberta, JCPT, March 1999). As illustrated in FIG. 8, a test on a horizontal well was inconclusive (AOSTRA (1999)).

4) Cyclic $CO_2$ stimulation is also a method to recover incremental oil. (Patton et al, Carbon Dioxide Well Stimulation: Part 1—A parametric study, JPT, August 1982). As illustrated in FIG. 10, process efficacy drops off dramatically for heavier oils.

Because of the limitations of the prior art, there is a need for a remediation process that reacts to the cresting/coning in oil wells, preferably heavier oil wells.

SUMMARY OF THE INVENTION

The following terms and acronyms will be used herein:

AOSTRA Alberta Oil Sands Technology Research Authority
AWACT Anti-Water Coning Technology
UNITAR United Nations Institute for Training and Research
JCPT Journal Canadian Petroleum Technology
CIM Canadian Institute of Mining
SPE Society of Petroleum Engineers
JPT Journal Petroleum Technology
SAGD Steam Assisted Gravity Drainage
GOR Gas to Oil Ratio
OC Oil Cut
Kro Relative permeability to Oil
Krw Relative permeability to Water
SACT Steam Anti Coning/Cresting Technology
STB Stock Tank Barrels
SRC Saskatchewan Research Council
HZ Horizontal (well)
VT Vertical (well)
OSR Oil to Steam Ratio
SOR Steam to Oil Ratio
DHOWS Down Hole Oil Water Separator
EOR Enhanced Oil Recovery
REC Recovery
OOIP Original Oil in Place Because of the need for a cresting/coning remediation process, SACT is a process that adds steam to the cone/crest zone and heats oil in the cone/crest zone and at the cone/crest zone edges. In a preferred embodiment, the steam addition is followed by a soak period to allow further heating of oil and to allow gravity to cause a re-saturation of the cone/crest zone. Preferably after the soak period, the oil well may then be returned to production.

Preferably, the SACT process is applied to 1) heavy oils where native oil viscosity is too high to allow rapid oil re-saturation of the cone/crest zone, preferably where the viscosity is >1000 cp, and 2) bitumen (SAGD) wells.

According to a primary aspect of the invention, there is provided a cyclic remediation process to restore oil recovery from a primary well that has watered off from bottom water encroachment (cone or crest) whereby:

(1) The primary well has a produced water cut in excess of 95% (v/v), (2) The oil is heavy oil, preferably with in-situ viscosity >1000 cp, and wherein said process comprises:

(3) Injection of steam in the cone/crest zone preferably by a steam slug with a preferred volume of 0.5 to 5.0 times the cumulative primary oil production, preferably where said steam is measured as water, (4) After steam injection is complete, the well is shut in for a soak period, (5) The well is then produced until the water cut exceeds 95%

In a preferred embodiment of the process the well was previously steamed.

Preferably the steam is injected using the existing primary oil production well.

In an alternative embodiment, the steam is added using a separate well.

In another embodiment of the process, the primary well is a horizontal well and bottom water encroachment forms a water crest zone beneath the primary well.

In another embodiment, in the event that the primary well is not suitable for steam injection, several substantially parallel horizontal wells may be linked with a separate perpendicular horizontal well completed in the steam crest zone of each of the parallel horizontal wells.

Preferably several of the substantially parallel horizontal wells may be linked at or near the midpoint of the horizontal well lengths, in the crest zone.

In another embodiment, the heavy oil is bitumen (API<10; μ>100,000 cp).

In another embodiment, there is provided a cyclic remediation process to restore bitumen recovery from a bitumen well that has watered off from bottom water encroachment (cone or crest) whereby:

(1) The primary well has a produced water cut in excess of 70% (v/v), (2) Injection of steam in the cone/crest zone preferably by a steam slug with a preferred volume of 0.5 to 5.0 times the cumulative primary oil production, preferably where said steam volumes is measured as water volumes, (3) After steam injection is complete, the well is shut in for a soak period, (4) The well is then produced until the water cut exceeds 70%.

In another embodiment, the bitumen production well is used for steam remediation injection.

In another embodiment, steam injection rates (measured as water) are 0.5 to 5.0 times fluid production rates when the primary well had watered off.

Preferably the steam quality at the steam injector well head is controlled between 50 and 100%.

Preferably the well is shut in for a soak period of 1 to 10 weeks.

DETAILED DESCRIPTION OF THE INVENTION

SACT is a remediation process for heavy oil wells (or for SAGD) that have coned or crested due to bottom water encroachment. The process is cyclic and has the following phases:

(1) The primary production well is shut-in due to high (or excessive) water cuts from bottom water encroachment (coning or cresting).

(2) Steam is injected into the cone or crest zone with at least a sufficient volume to displace the bottom water in the cone/crest zone.

(3) The well is shut-in to soak for a period of time (weeks-months). This allows heat from the steam to be conducted to oil in/near the cone/crest zone, reducing the oil viscosity by heating and allowing the oil to re-saturate the cone/crest zone by gravity.

(4) The well is put back on production.

(5) The process can be repeated.

Figure 11:
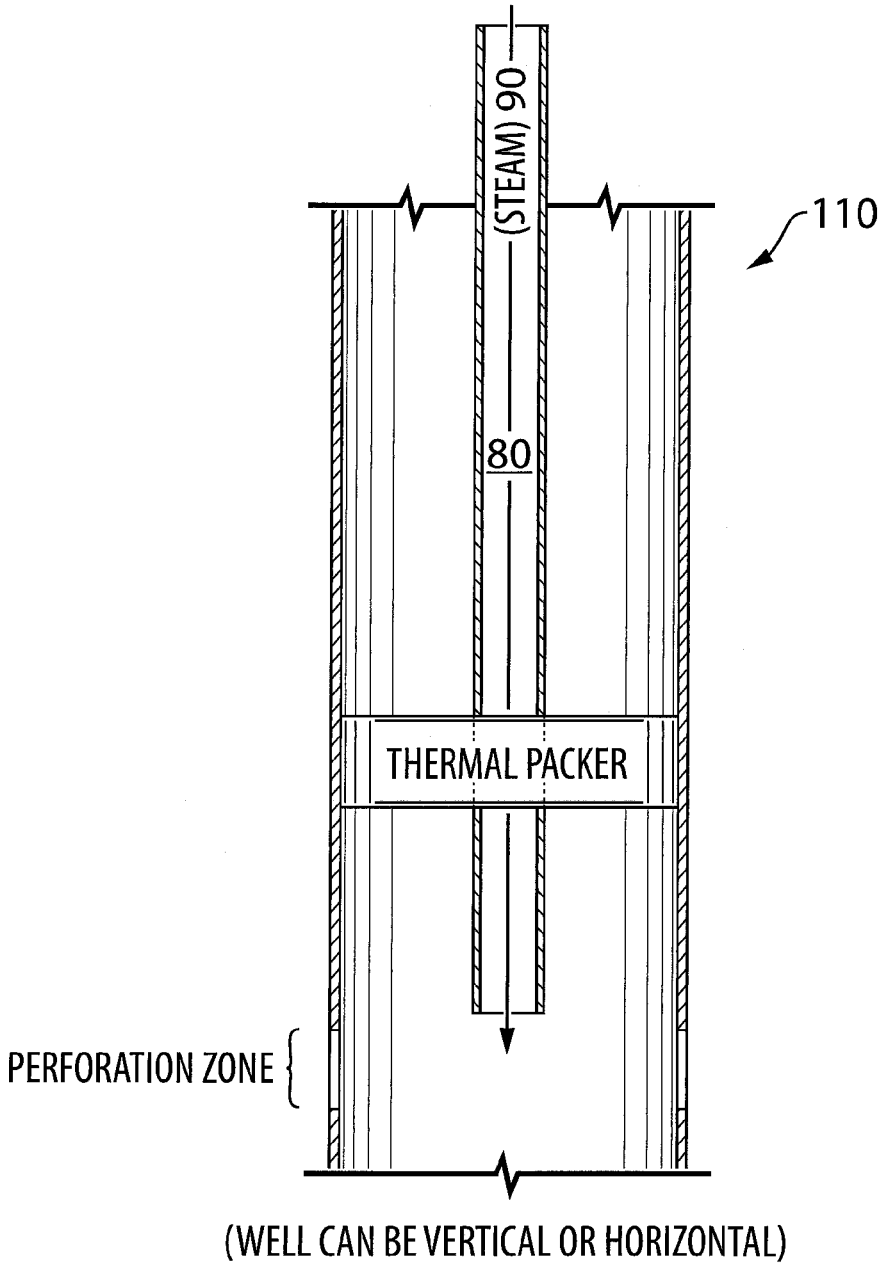
FIG. 11 depicts the injection of steam via a steam string for SACT according to an embodiment of the present invention
Figure 12:
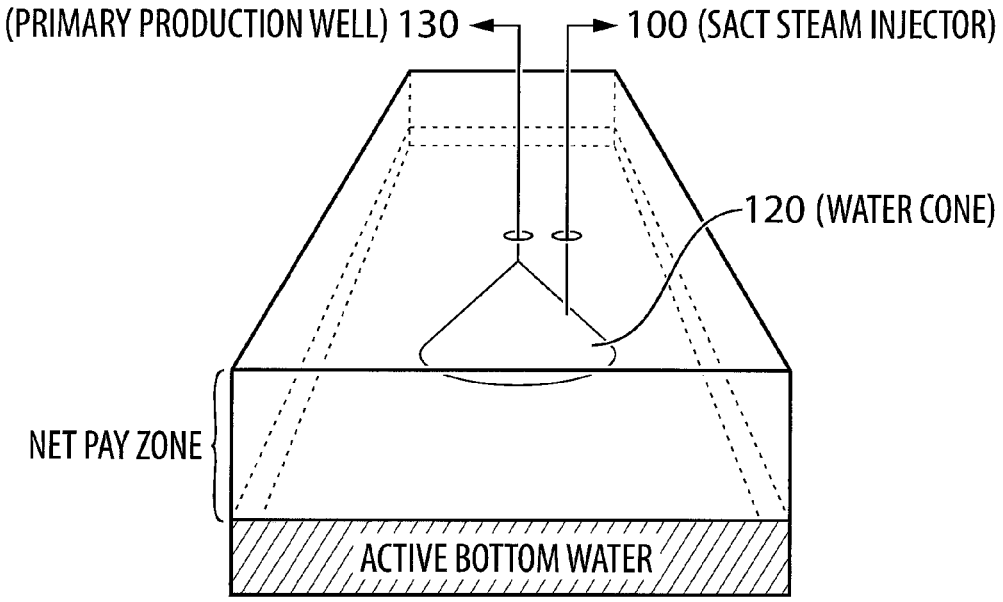
FIG. 12 depicts the injection of steam via a separate steam injector for SACT according to an embodiment of the invention

One of the issues for a conventional heavy oil production facility is that primary production wells are not designed for steam injection. The production wells can be damaged by thermal expansion, and the cement isn't designed for high temperature operations. This problem can be mitigated by one of the following options:

(1) As illustrated in FIG. 11, the use of an injection string 80 with separate tubing (and insulation) for steam 90 injection to minimize the heating of the primary well 110; or (2) As illustrated in FIG. 12, drill and thermally complete a separate steam injection well 100 for remediation of a single well 130; or.

Figure 13:
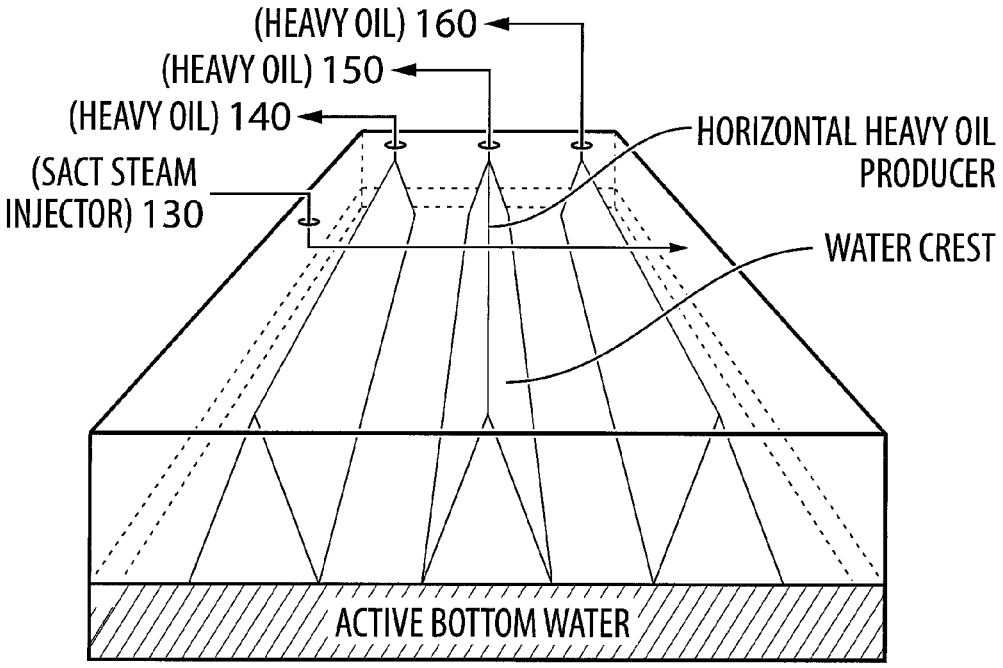
FIG. 13 depicts SACT well for Crested Heavy Oil Wells

(3) As illustrated in FIG. 13, drill and thermally complete a separate steam injection well 100 linked to several wells 140 150 160, allowing for simultaneous remediation.

Referring to FIG. 11, an injection steam string 80 with separate tubing and insulation to minimize the heating of the primary well 110 is shown. The well in this instance may be vertical or horizontal.

Referring to FIG. 12 a separate steam injection well 100 is used to inject steam in to the water cone 120 according to the present invention. In this Figure, a vertical well configuration is shown for use with a single primary production well 130.

Referring to FIG. 13 a SACT steam injector horizontal well 100 is linked to a plurality of horizontal producing wells 140, 150 and 160 to ensure crested heavy oil wells are simultaneously remediated according to the present invention.

Figure 1:
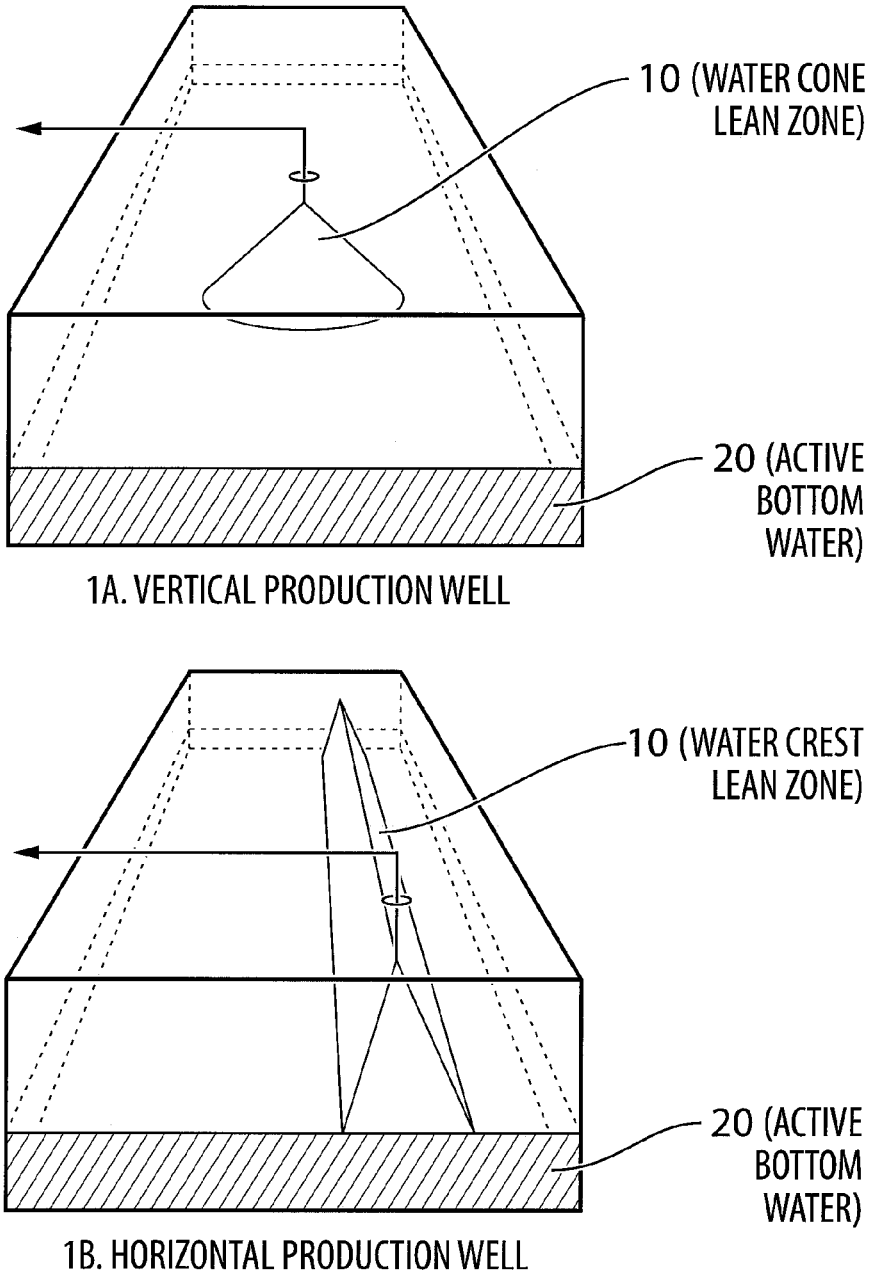
FIGS. 1A and 1B respectively depict the water cone lean zone of a vertical production well and the water crest lean zone of a horizontal production well
Figure 2:
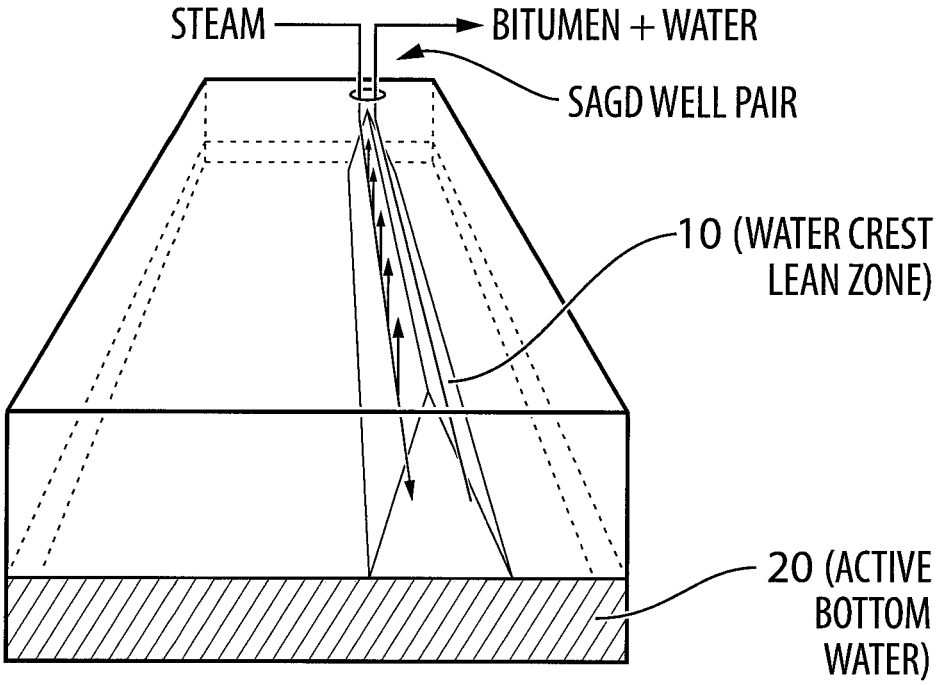
FIG. 2 depicts a SAGD Bitumen Lean Zones (Bottom Water)
Figure 3:
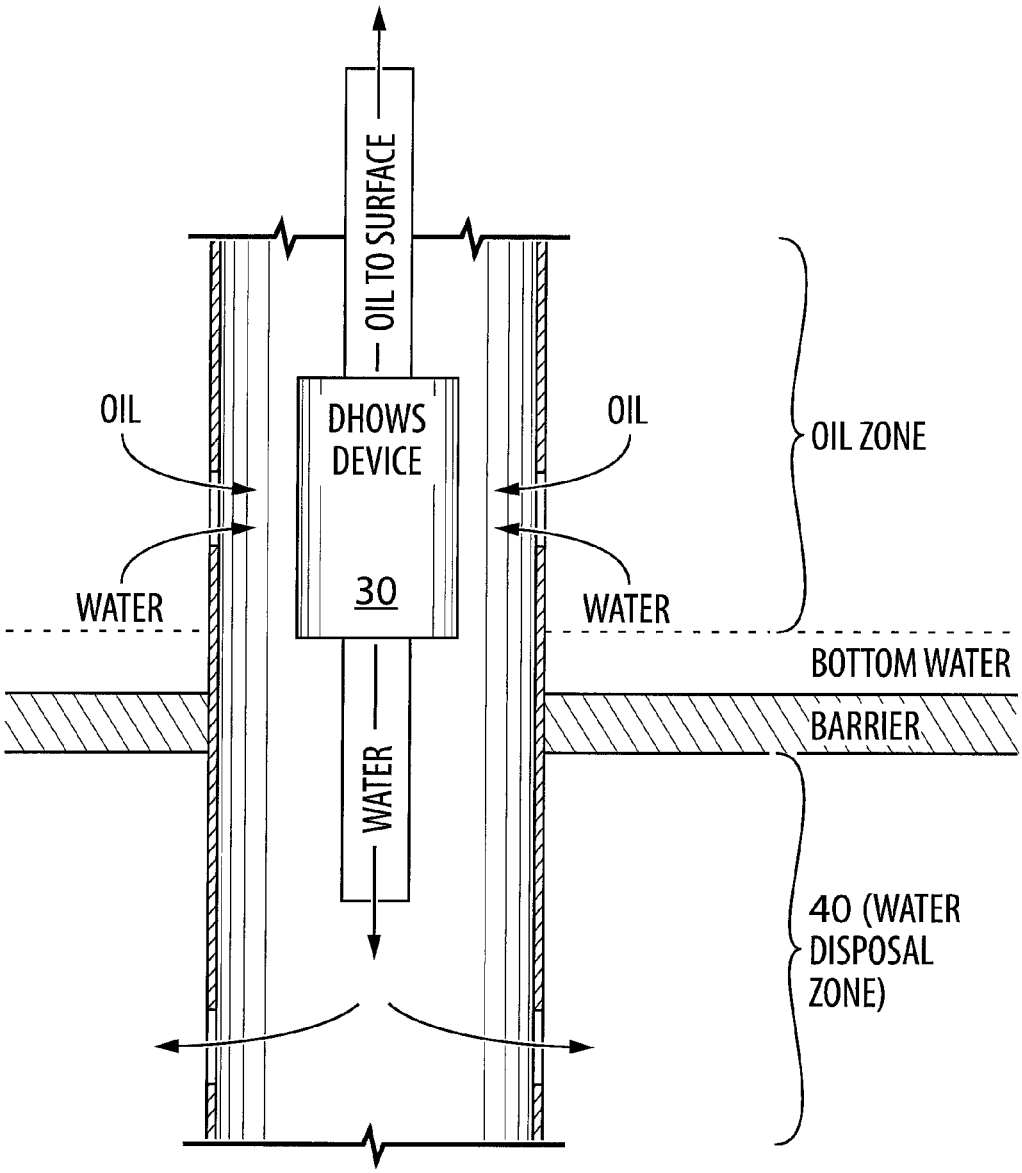
FIG. 3 depicts the prior art DHOWS concept
Figure 4:
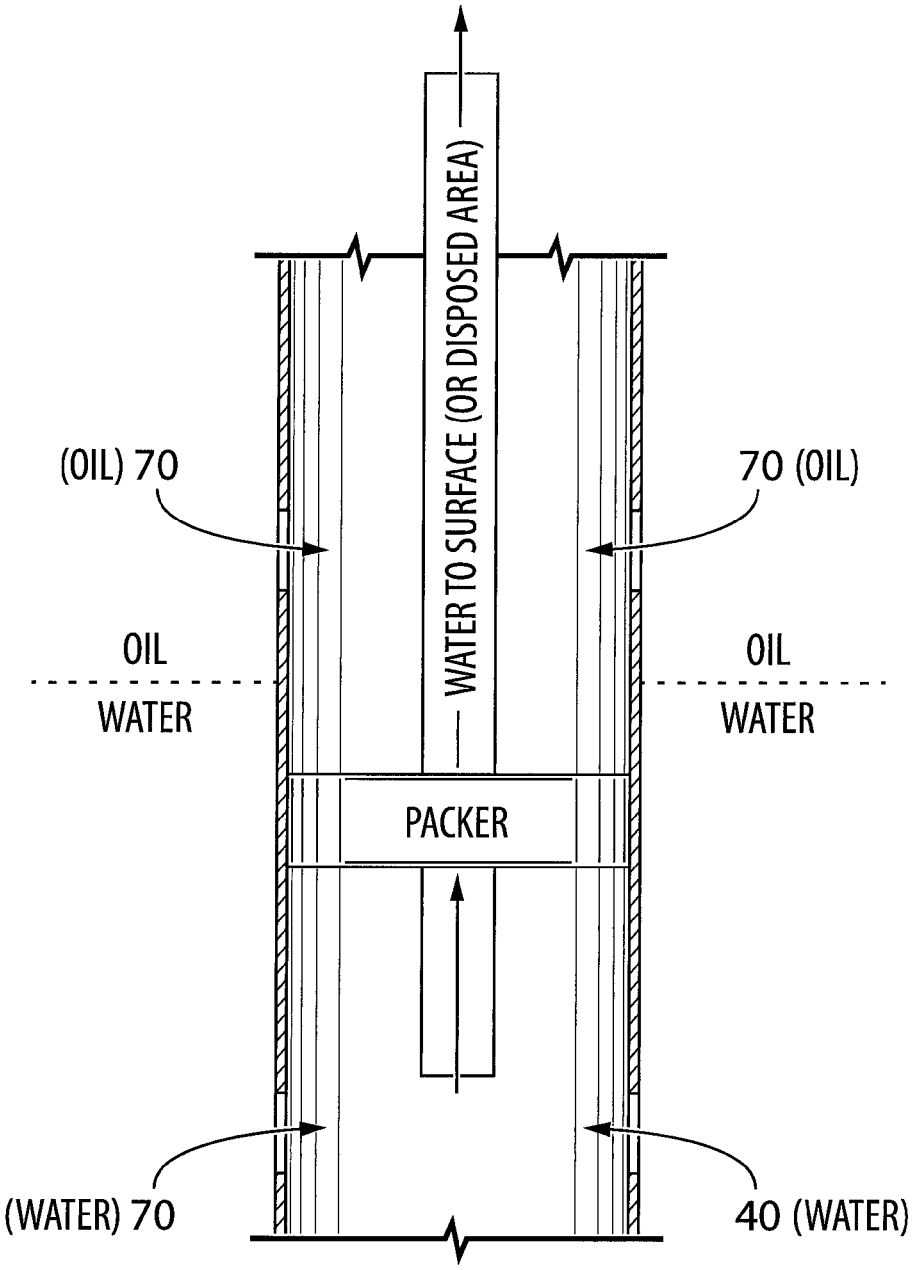
FIG. 4 depicts the prior art Reverse Coning Control
Figure 5:
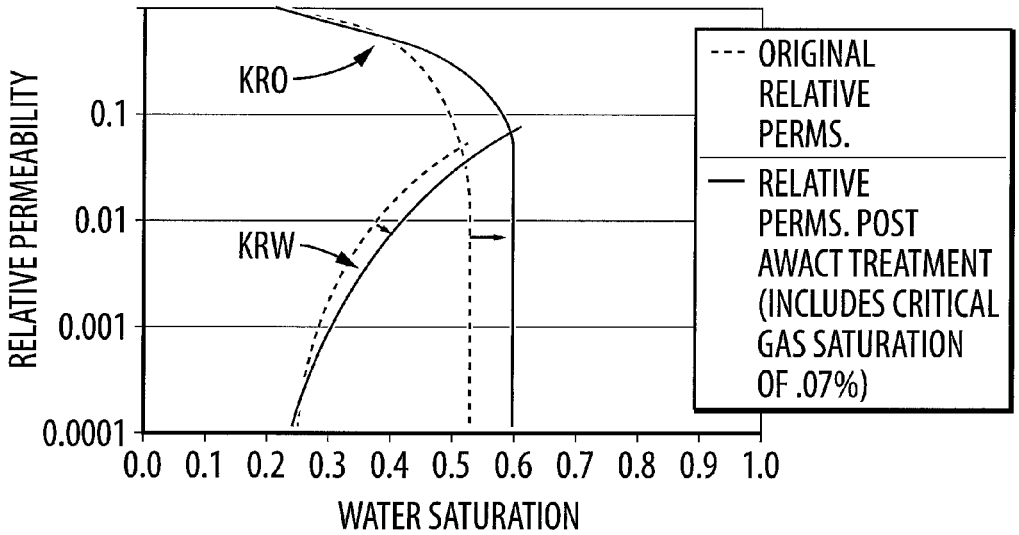
FIG. 5 depicts the AWACT effects on Relative permeability
Figure 6:
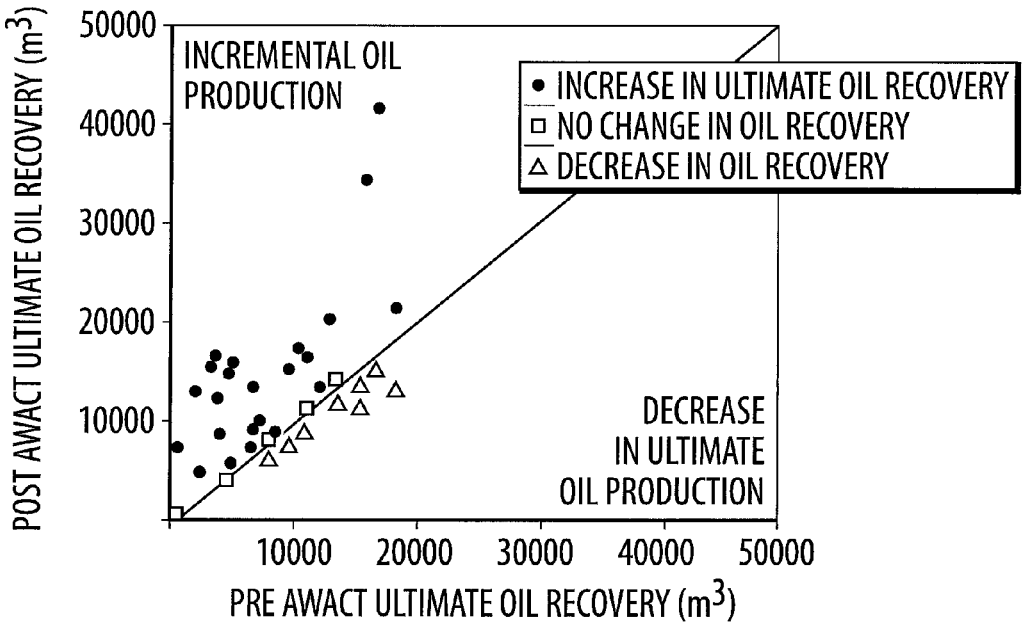
FIG. 6 depicts the Incremental AWACT Reserves in pre and post AWACT oil recovery
Figure 7:
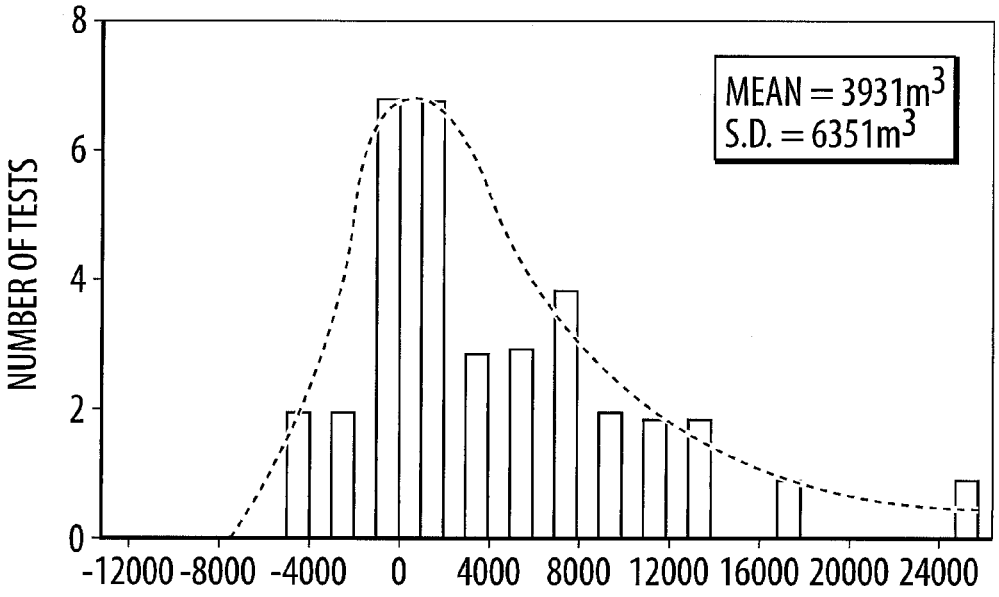
FIG. 7 depicts the Frequency distribution of incremental oil following AWACT
Figure 8:
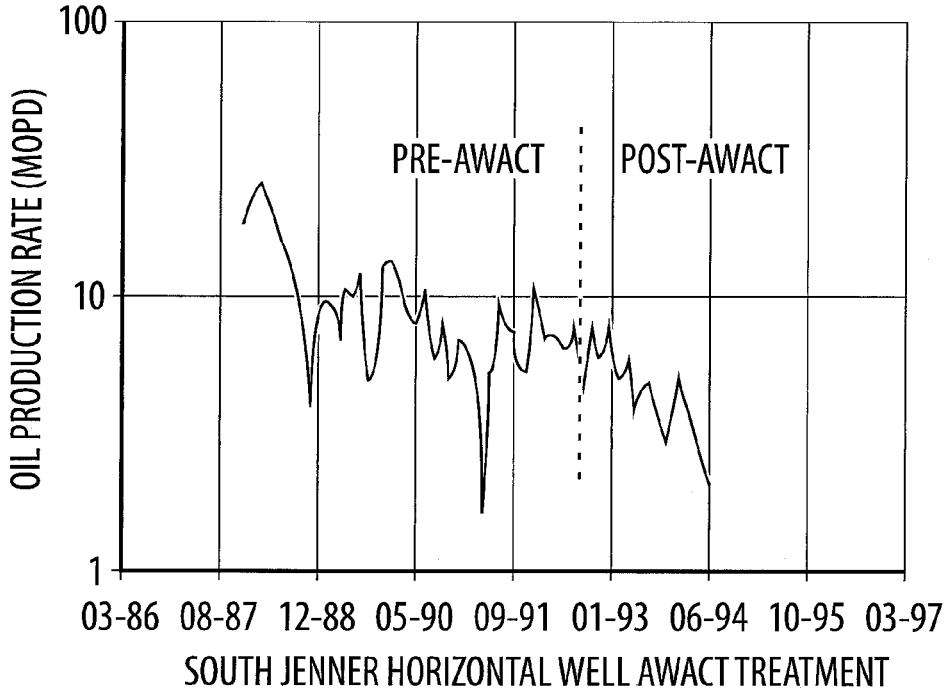
FIG. 8 depicts oil production and oil cut history of horizontal wells pre and post AWACT
Figure 8:
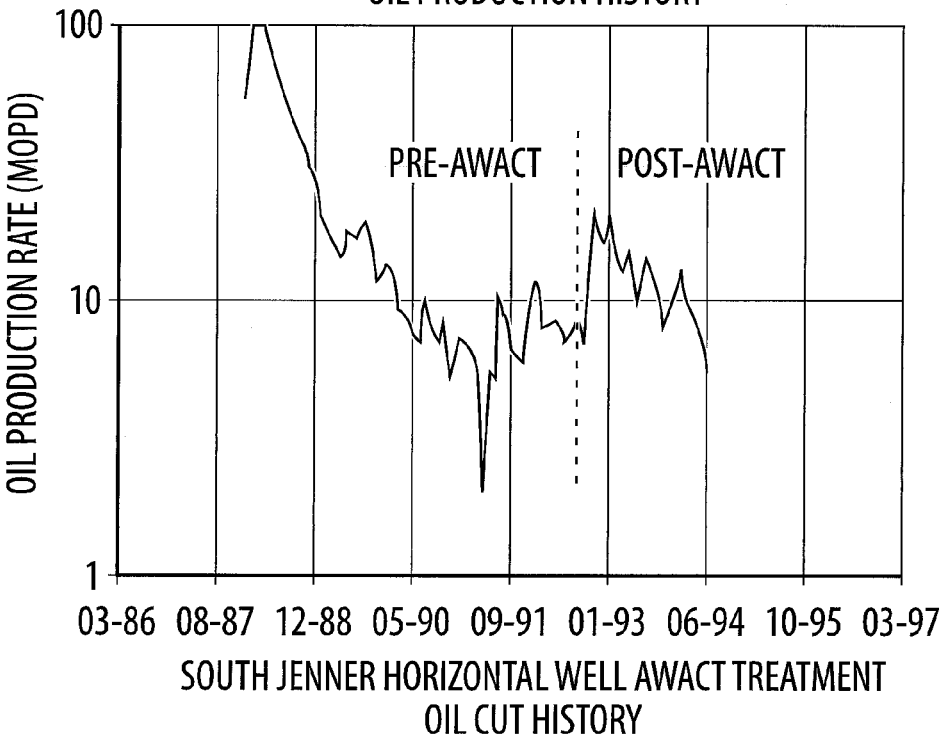
Figure 9:
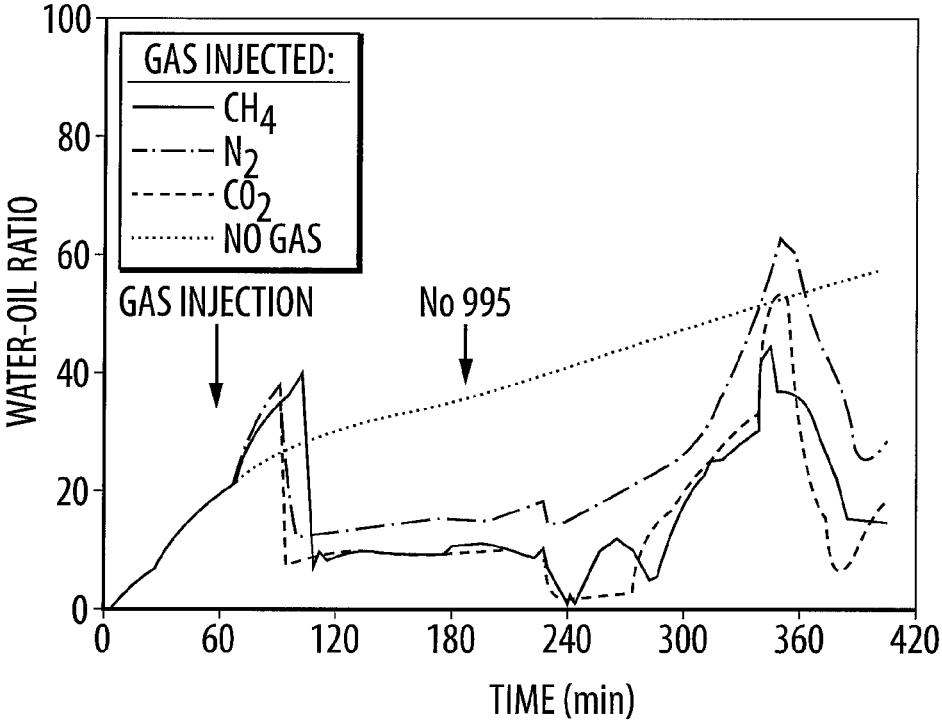
FIG. 9 depicts the AWACT laboratory tests and water-oil ratios versus time of various gases
Figure 10:
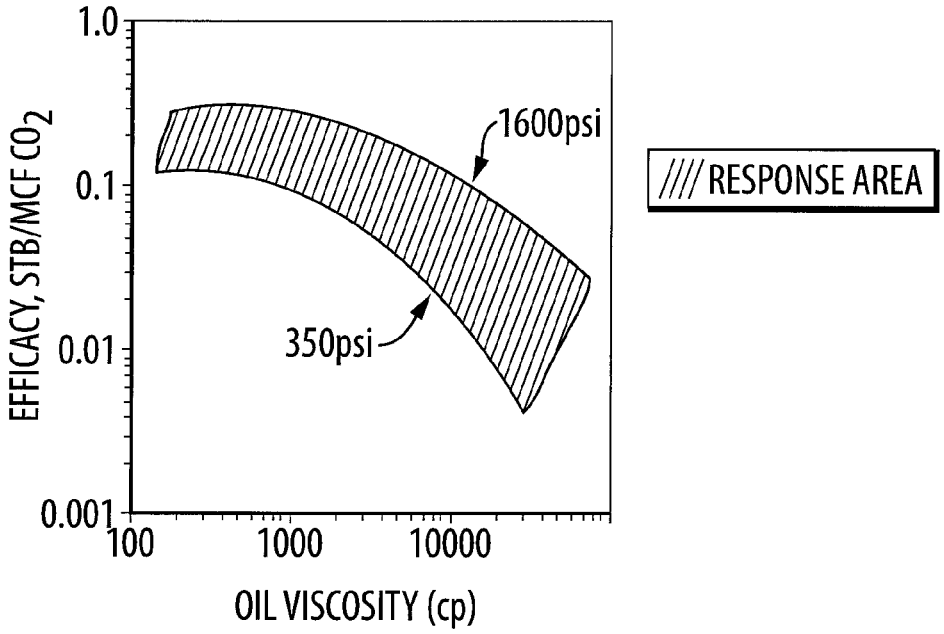
FIG. 10 depicts the stimulation of $CO_2$ of Oil Wells versus oil viscosity

Bitumen SAGD is a special analogous case for SACT process applications. If the SAGD project has an active bottom water 20, we can expect that the lower SAGD production well will cone/crest eventually (FIG. 2). Bitumen (<10API, >100,00 cp in situ viscosity) is heavier and more viscous than heavy oil (1000 to 10,000 cp), but after bitumen is heated it can act similarly to heavy oil.

If bitumen is above an active bottom water, SAGD can, theoretically, produce bitumen without interference from bottom water, if process pressures are higher than native reservoir pressure, if the pressure drop in the lower SAGD production well doesn't breach this condition, and if the bottom of the reservoir (underneath the SAGD production well) is "sealed" by high viscosity immobile bitumen underneath the production well. But, this is a delicate balance for the following reasons:

(1) Steam pressures can't be too high or a channel may form allowing communication with the bottom water. Subsequent fluid losses can, at best, reduce efficiency and at worst, shut the process down. Water production will be less than steam injection.

(2) The initial remedy to this is to reduce pressures. But, steam pressures can't be too low or water will be drawn from the bottom water zone into the production well (coning/cresting). Water production will exceed steam injection. Also, one of the process controls for SAGD is sub-cool (steam trap control) assuming the near-well bore zone is at saturated steam temperature. This control will be lost when bottom water breaches the production well.

Figure 14:
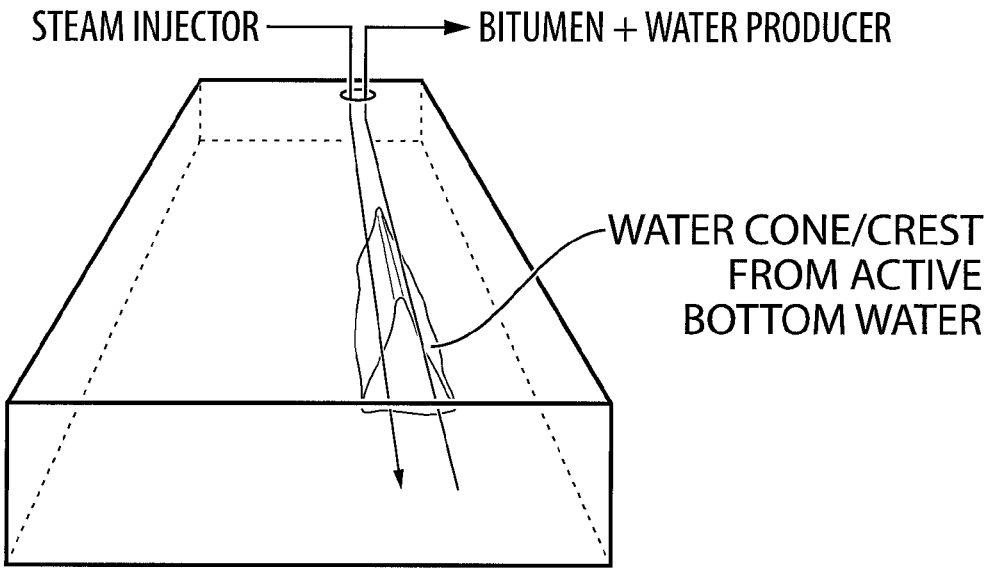
FIG. 14 depicts SAGD partial coning/cresting

(3) As illustrated in FIG. 14, if the SAGD reservoir is inhomogeneous or if the heating pattern is inhomogeneous, the channel or the cone/crest can be partial and the problem can be accelerated in time.

Figure 15:
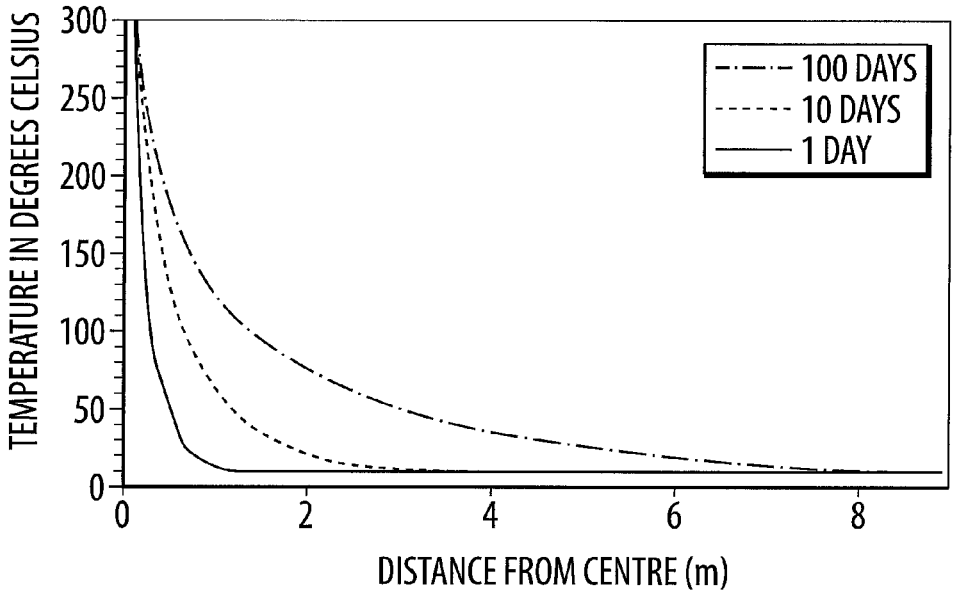
FIG. 15 depicts heat conducted around a hot well

(4) Initially, cold bitumen underneath the production well will act as a barrier to prevent channeling, coning or cresting. But, as the SAGD process matures, after a few years, the bottom bitumen will be heated by conduction (FIG. 15) and in situ viscosity will be similar to heavy oil, with increased chances of channeling, coning and cresting.

Once the production well has coned/crested, the SACT process can be applied. Unlike heavy oil, the SAGD production well has been thermally completed and it can be used as a SACT steam injector.

Again, the SACT process is cyclic with the following steps:

(1) Shut-in the SAGD producer and convert it to a steam injector.

(2) Maintain target pressures in the SAGD steam chamber closer to but slightly above in situ pressures by using the steam injector well.

(3) Inject a slug of steam into the SAGD production well.

(4) Shut in both SAGD wells for a soak period (weeks-months) to allow bitumen to be heated and to re saturate the cone/crest area.

(5) The process can be repeated.

EXAMPLE

Nexen conducted a simulation study of SACT using the Exotherm model. Exotherm is a three-dimensional, three-phase, fully implicit, multi-component computer model designed to numerically simulate the recovery of hydrocarbons using thermal methods such as steam injection or combustion.

The model has been successfully applied to individual well cyclic thermal stimulation operations, hot water floods, steam floods, SAGD and combustion in heavy hydrocarbon reservoirs (T. B. Tan et al., Application of a thermal simulator with fully coupled discretized wellbore simulation to SAGD, JCPT, January 2002).

We simulated the following reservoir:

| |
|---|
| Pressure - 6200 kPa |
| Temperature - 28 degrees Celsius |
| Porosity - 33% |
| Initial water Sat. - 30% |
| In-situ viscosity - 2000 cp |
| Oil pay - 16 m |
| Bottom water - 10 m |
| HZ well spacing - 75 m |
| HZ well length - 1000 m |

We simulated SACT after primary production coned/crested wells. For a vertical well we used steam slug sizes from 50-200 $m^3$. For horizontal wells we used slug sizes an order-of-magnitude larger.

Figure 16:
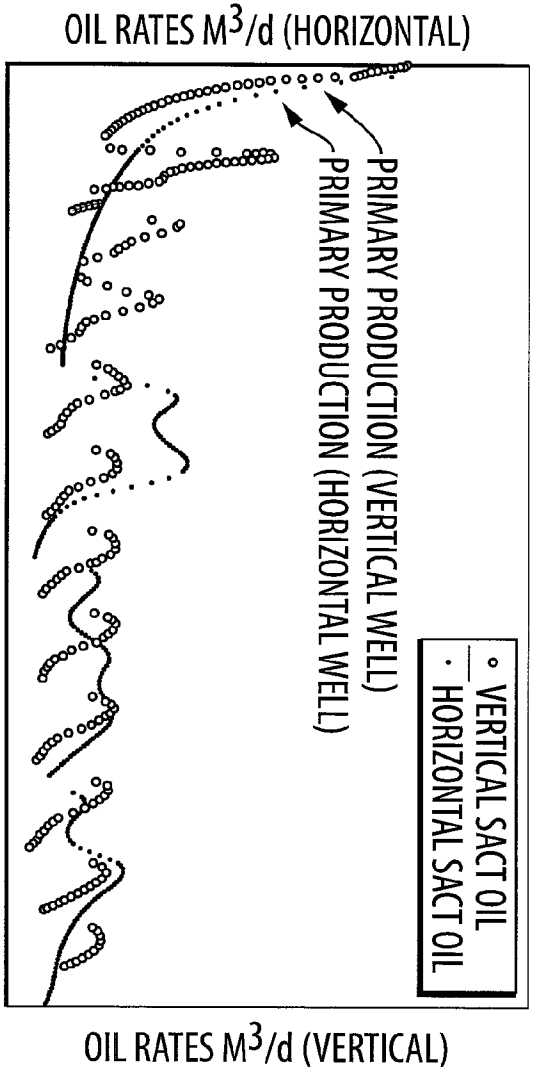
FIG. 16 depicts SACT simulation in vertical and horizontal wells according to the present invention

FIG. 16 shows simulation results for SACT and a comparison of horizontal and vertical well behavior. Based on the simulation results, the following is observed:

(1) The primary production period for vertical wells is much shorter than for horizontal wells—about a quarter of the time—until the wells are watered off (2) The primary productivity of vertical wells is about a factor of 10 less than for horizontal wells. SACT productivities maintained this ratio.

(3) The SACT cycle times are larger for horizontal wells. In the period shown in FIG. 16—about 3 yrs.—we have 11 SACT cycles for vertical wells compared to only 3 cycles for horizontal wells.

Figure 17:
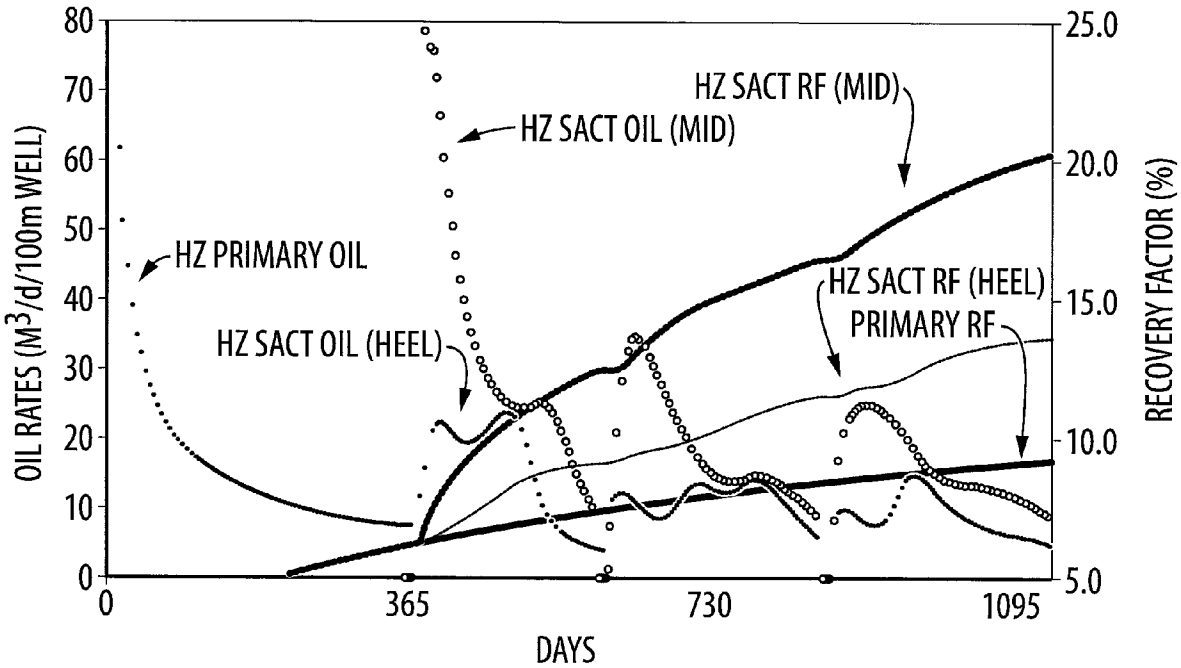
FIG. 17 depicts SACT simulation in horizontal wells

FIG. 17 shows a comparison of SACT for horizontal wells, where the steam injection was applied at the heel and at the mid-point of the wells.

Based on the results shown in FIG. 17, the following is observed:

(1) Primary recovery factor for a horizontal well is about 9% OOIP.

(2) The SACT process, over a period of 2 years after primary production, recovered an extra 5% OOIP for SACT applied at the heel of the horizontal well and an extra 12% OOIP for SACT applied at the mid-point of the horizontal well. This incremental RF is significant when compared to primary production.

(3) The first cycle of SACT applied to the mid-point of the horizontal well produced a production profile better than the primary producer.

In 1995-96 Nexen contracted SRC to conduct a scaled-physical model test of the SACT process based on the following:

14 m oil pay column
16 m active bottom water column
32% porosity
4D permeability
3600 cp in-situ viscosity
980 kg/$m^3$ oil density (API=12.9)
28° C., 5 Mpa reservoir T,P
150 m well spacing, 1200 m horizontal well length Tables 2, 3, 4 and FIGS. 18, 19, 20, 21 present the results of the studies. Based on the results of these studies, the following was observed:

(1) For horizontal wells, steam slug sizes varied from about 36,000 to 54,000 cubic meters (225 K bbl to 340 K bbl) (Table 2). For vertical wells, steam slug size varied from about 500 to 1100 cubic meters (3100 to 7000 bbls. At least within the range studied, steam slug size is not very sensitive (FIG. 19)). The slug size ratio horizontal/vertical is about 50-70. (Table 3).

Figure 18:
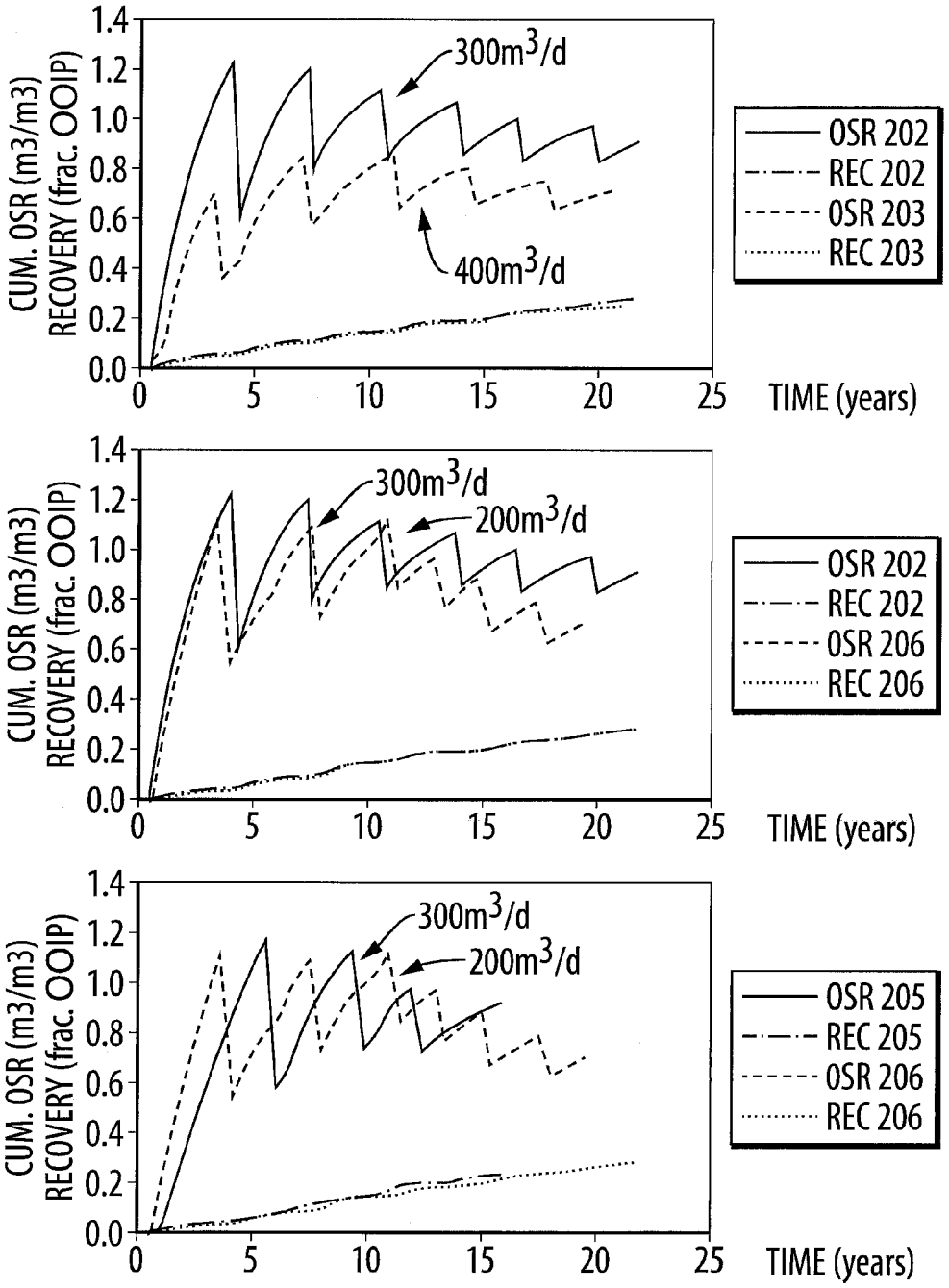
FIG. 18 depicts SACT Scaled Physical Model Steam Injection Rates
Figure 19:
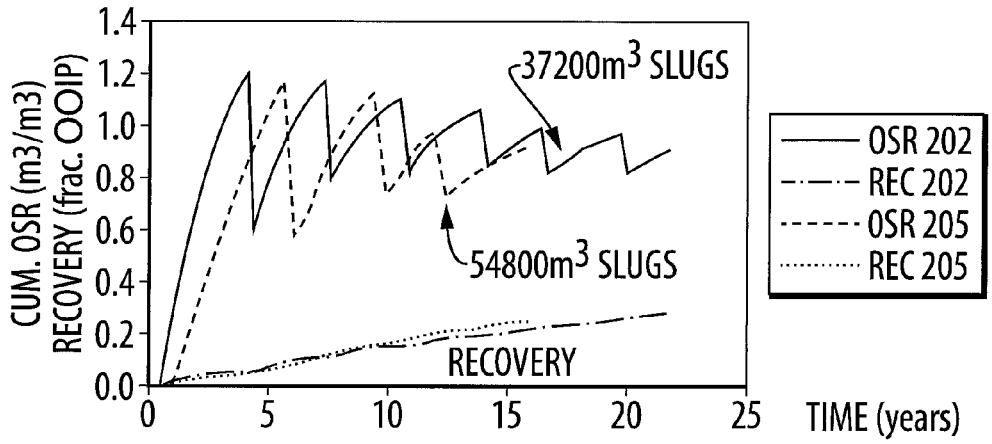
FIG. 19 depicts SACT Scaled Physical Model Steam Slug Sizes

(2) Steam injected rate varied from about 300 to 400 m3/d (1900 to 2500 bbl/d) for horizontal wells (Table 2) and at about 9.3 m3/d (60 bbl/d) for vertical wells (Table 3). The horizontal/vertical ratio, defined as the ratio of length of contact with oil portion of reservoir, is from about 30 to 43. Steam injection rate is not a sensitive variable (FIG. 18).

(3) The SACT process was tested for 4 to 7 cycles for horizontal wells and 3 cycles for vertical wells.

(4) Recovery factors varied from 25 to 36% for horizontal wells and 36 to 43% for vertical wells (OOIP is much higher for horizontal well patterns).

(5) OSR is the key economic indicator. Horizontal wells SACT OSR varied from 0.73 to 0.95 (SOR for 1.4 to 1.1). Vertical well OSR varied from 0.47 to 0.56. In comparison, a good SAGD process has an OSR=0.33

Figure 20:
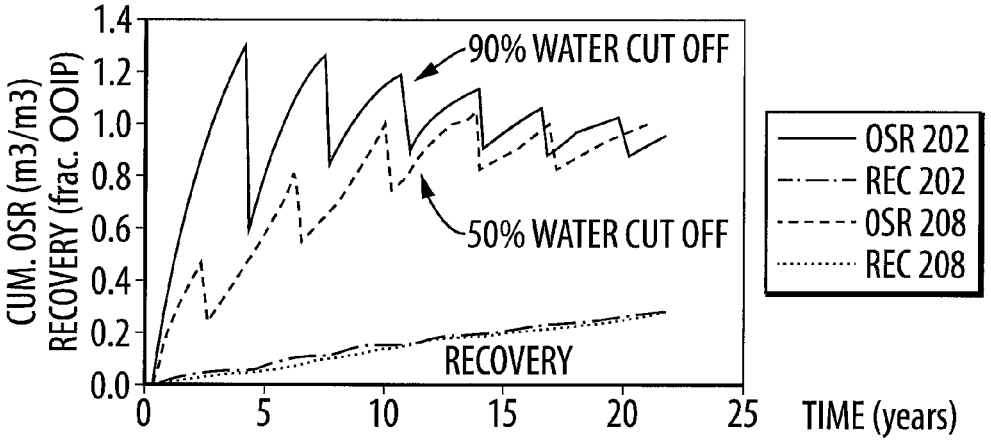
FIG. 20 depicts SACT Scaled Physical Model Water Cut Offs

(6) FIG. 20 shows water cut offs (when production is stopped) are best at higher levels (90% vs. 50%).

Figure 21:
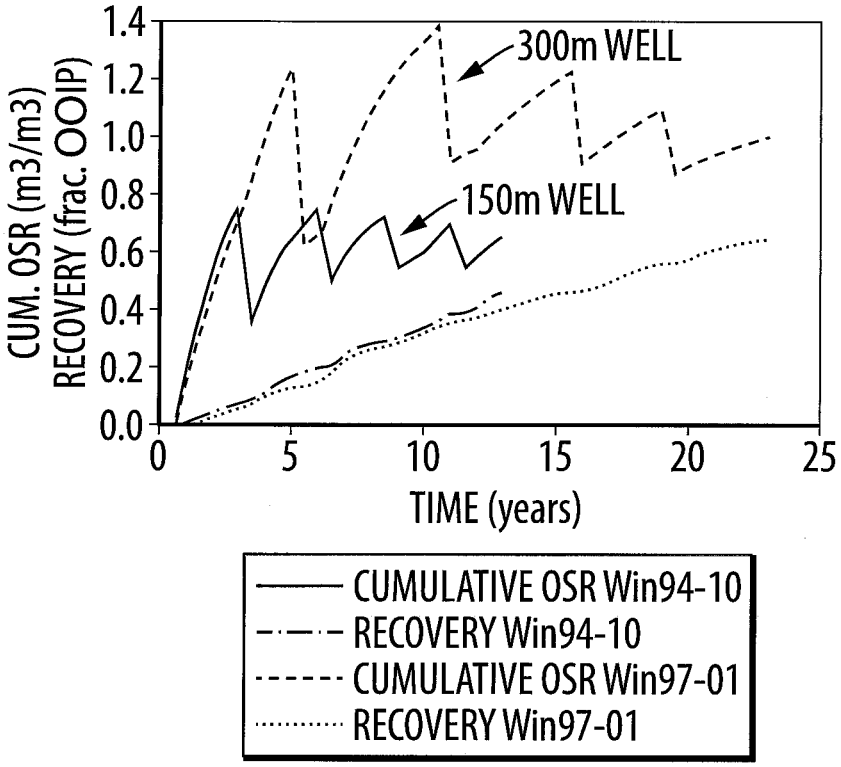
FIG. 21 depicts SACT Scaled Physical Model Horizontal Well Lengths

(7) FIG. 21 shows better performance for longer horizontal wells (300 m vs. 150 m) but it is not necessarily at optimum lengths.

TABLE 2

Scaled Physical Model Test Results Horizontal Wells

| | | | | | |
|---|---|---|---|---|---|
| Reservoir Conditions: | | | | | |
| Porosity (%) | 35.8 | 35.0 | 34.8 | 35.7 | 35.2 |
| OOIP ($m^3$) | 816100 | 819300 | 817500 | 798700 | 785000 |
| Oil Sat. (%) | 93.3 | 94.0 | 94.1 | 91.1 | 91.1 |
| Prim. Prod. (% OOIP) | 2.8 | 1.7 | 5. | 3.7 | 2.7 |
| Tests: | | | | | |
| No. of Cycles | 7 | 6 | 4 | 6 | 7 |
| Ran length (yrs) | 21.9 | 20.9 | 16.0 | 21.0 | 24.3 |
| Stm. inj. rate ($m^3$/d) | 301.4 | 401.6 | 299.1 | 300 | 300 |
| Stm. slug size ($m^3$) | 36120 | 48200 | 53840 | 36000 | 54000 |
| Cum. stm. inj. ($m^3$) | 260187 | 291663 | 219269 | 217751 | 384664 |
| Steam Q (%) | 70 | 70 | 70 | 70 | 70 |
| Cycle shut off (% w) | 90 | 90 | 90 | 50 | 50 |
| Performance: | | | | | |
| Recovery (% OOIP) | 29.0 | 26.1 | 25.0 | 26.2 | 36.4 |
| Cum. OSR | .91 | .73 | .93 | .95 | .73 |
| Oil Rate ($m^3$/cd) | 29.6 | 28.0 | 34.9 | 27.3 | 32.2 |
| Wat. Rate ($m^3$/cd) | 53.5 | 48.5 | 33.2 | 3.4 | 6.4 |

(SRC (1997))

Where (1) primary production used in all cases to establish water crests.

Based on the studies and simulations discussed herein, it appears that the SACT process of the present invention works best for heavy oil cone/crests, since heating the zone and the oil can improve oil mobility dramatically compared to light oils.

If the heavy oil is produced using horizontal production wells and crests have formed from an active bottom water, a preferred way to link the well crests is a substantially perpendicular horizontal well about mid-way along the crest. (FIG. 13) The well is thermally completed for steam injection.

The steam slug should be preferably 0.5 to 5.0 times the cumulative primary oil production, on a water equivalent basis (ie. steam measured as water volumes). The steam injection rate is determined by injection pressures—preferably no more than 10% above native reservoir pressures at the sand face.

Enough time is needed for the steam to heat surrounding oil and the oil to re saturate the cone (crest zone)—based on the above, it is preferably between 1 to 10 weeks after the end of the steam cycle.

The process may be repeated when the water cut in produced fluids exceeds about 95% (v/v).

Some of the preferred embodiments of the present invention are provided below.

(1) Heavy oil (>1000 cp in-situ viscosity)

(2) Well geometry to connect/link to parallel primary horizontal producers in cresting zone.

(3) Preferred linkage near mid-point of horizontal producers.

(4) Steam slug size limits (5) Soak period limits (6) Application to SAGD bitumen producer with bottom water (7) Cyclic remediation process (not continuous)

(8) Applies to both horizontal and vertical wells (9) Steam injection rate limits

(10) Steam quality limits

Other embodiments of the invention will be apparent to a person of ordinary skill in the art and may be employed by a person of ordinary skill in the art without departing from the spirit of the invention.

TABLE 3

SACT Scaled Physical Model Tests Vertical Wells

| | | |
|---|---|---|
| Reservoir Conditions: | | |
| OOIP ($m^3$ | 4205 | 4205 |
| Spacing ($m^2$) | 900 | 900 |
| Oil Sat. (%) | 94.0 | 31.2 |
| Prim. Prod. (% OOIP) | 15.3 | 14.1 |
| Gas Cap | yes(1) | no |
| Tests: | | |
| No. of Cycles | 3 | 3 |
| Run length (yrs) | 5.8 | 6.5 |
| Stm. inj. rate ($m^3$/d) | 9.3 | 9.3 |
| Stm. slug size ($m^3$) | 1116 | 558 |
| Cum. stm. inj. ($m^3$) | 3348 | 1674 |
| Performance: | | |
| Recovery (% OOIP) | 43.4 | 35.9 |
| Cum. OSR | 0.47 | 0.56 |
| Oil Rate ($m^3$/cd) | 0.86 | 0.63 |
| Wat. Rate ($m^3$/cd) | 3.19 | 0.84 |

SRC(1997)

TABLE 4

| SACT Scaled Physical Model Tests Vertical vs. Horizontal Wells | | | | | |
|---|---|---|---|---|---|
| | End of Primary Production | End of cycle 1 | End of cycle 2 | End of cycle 3 | End of cycle 4 |
| Vertical Well (Win 207) | | | | | |
| time: start of primary production | 3.0 | 4.2 | 5.7 | 6.5 | — |
| : start of EORR | — | 1.2 | 2.7 | 3.5 | — |
| OSR: in cycle | — | 0.39 | 0.73 | 0.56 | — |
| : cumulative | — | 0.39 | 0.56 | 0.56 | — |
| Recovery: in cycle | 14.1 | 5.3 | 9.8 | 6.3 | — |
| (% OOIP): cumulative | 14.1 | 19.4 | 29.2 | 35.9 | — |
| Horizontal Wells | | | | | |
| time: start of primary production | 6.0 | 11.6 | 15.6 | 18.1 | 22.1 |
| : start of EORR | — | 5.6 | 9.6 | 12.1 | 15.1 |
| OSR: in cycle | — | 1.17 | 1.06 | 0.70 | 0.77 |
| : cumulative | — | 1.17 | 1.12 | 0.98 | 0.93 |
| Recovery: in cycle | 5.9 | 7.8 | 13.1 | 4.7 | 5.3 |
| (% OOIP): cumulative | 5.9 | 7.8 | 20.9 | 25.6 | 30.9 |

(SRC (1997))

The invention claimed is:

1. A cyclic remediation process to restore oil recovery from a primary oil production well that has watered off from bottom water encroachment whereby:

(a) the primary oil production well has a produced water cut in excess of 95% (v/v);

(b) the oil is heavy oil, with in-situ viscosity >1000 cp; wherein said process comprises:

(c) injecting a steam slug with a volume of 0.5 to 5.0 times the cumulative primary oil production, with steam volumes measured as water volumes;

(d) shutting in the well for a soak period after the steam injection is complete; and (e) producing the well until the water cut exceeds 95%.

2. The process according to claim 1, where the primary oil production well has been previously steamed.

3. The process according to claim 1, where the steam is injected using the existing primary oil production well.

4. The process according to claim 1, where the steam is added using a separate well.

5. The process according to claim 1, where the primary oil production well is a horizontal well and bottom water encroachment forms a water crest zone beneath the primary oil production well.

6. The process according to claim 5, where the primary oil production well is not suitable for steam injection and several substantially parallel horizontal wells are linked with a separate substantially perpendicular horizontal well completed in the steam crest zone of each of the substantially parallel horizontal wells.

7. The process according to claim 6, where the separate substantially perpendicular horizontal well is linked at or near the midpoint of the horizontal well lengths, in the crest zone.

8. The process according to claim 1, where the heavy oil is bitumen.

9. The process according to claim 8, wherein the bitumen has API<10 and μ>100,000 cp.

10. A cyclic remediation process to restore bitumen recovery from a bitumen production well that has watered off from bottom water encroachment whereby:

(a) the bitumen production well has a produced water cut in excess of 70% (v/v);

(b) injecting a steam slug with a volume of 0.5 to 5.0 times the cumulative bitumen, with steam volumes measured as water volumes;

(c) shutting in the well for a soak period after the steam injection is complete; and (d) producing the well until the water cut exceeds 70%, wherein bitumen is an in-situ hydrocarbon with <10 API gravity and >100,000 cp. in-situ viscosity.

11. The process according to claim 10, where the bitumen production well is used for steam remediation injection.

12. The process according to claim 10 where steam injection rates are 0.5 to 5.0 times fluid production rates when the primary well had watered off.

13. The process according to claim 10 where steam quality at the steam injector well head is controlled between 50 and 100%.

14. The process according to claim 10 where the well is shut in for a soak period of 1 to 10 weeks.

* * * * *